US010368601B2

(12) United States Patent
Greenblat et al.

(10) Patent No.: US 10,368,601 B2
(45) Date of Patent: Aug. 6, 2019

(54) MODULAR FACE MASK

(71) Applicant: Performance Apparel Corporation, San Luis Obispo, CA (US)

(72) Inventors: Jerris E. Greenblat, Los Osos, CA (US); Guy N. Wells, San Luis Obispo, CA (US)

(73) Assignee: Performance Apparel Corporation, San Luis Obispo, CA (US)

( * ) Notice: Subject to any disclaimer, the term of this patent is extended or adjusted under 35 U.S.C. 154(b) by 66 days.

(21) Appl. No.: 15/364,062

(22) Filed: Nov. 29, 2016

(65) Prior Publication Data

US 2018/0146733 A1 May 31, 2018

(51) Int. Cl.
*A42B 1/04* (2006.01)
*A41D 13/11* (2006.01)

(52) U.S. Cl.
CPC ..... *A42B 1/046* (2013.01); *A41D 13/1153* (2013.01)

(58) Field of Classification Search
CPC ..... A42B 1/046; A42B 1/00; A42B 1/06
See application file for complete search history.

(56) References Cited

U.S. PATENT DOCUMENTS

| | | | |
|---|---|---|---|
| 1,655,007 | A | 1/1928 | Boettge |
| 3,333,585 | A | 8/1967 | Barghini et al. |
| 3,768,100 | A | 10/1973 | Coleman et al. |
| 4,300,240 | A | 11/1981 | Edwards |
| 4,300,549 | A | 11/1981 | Parker |
| 4,825,474 | A | 5/1989 | Edwards |
| 4,941,211 | A | 7/1990 | Blutstein |
| 5,109,548 | A | 5/1992 | Balaban et al. |
| 5,214,804 | A | 6/1993 | Carey et al. |
| D339,676 | S | 9/1993 | Geving |
| 5,309,574 | A | 5/1994 | Balaban et al. |
| D369,442 | S | 8/1996 | Jones |
| 5,575,009 | A | 11/1996 | Ryvin |
| 5,809,572 | A | 9/1998 | Sisolak |
| 5,884,336 | A | 3/1999 | Stout |
| 6,272,690 | B1 | 8/2001 | Carey et al. |
| 6,928,657 | B2 | 8/2005 | Bell et al. |
| D518,625 | S | 4/2006 | Barnhouse |
| 7,188,374 | B2 | 3/2007 | Carey |
| 7,681,251 | B2 | 3/2010 | Carey |
| D657,917 | S | 4/2012 | Chen |
| D666,364 | S | 8/2012 | Votel et al. |
| 8,733,357 | B2 | 5/2014 | Sullivan, Jr. |
| 2003/0005934 | A1 | 1/2003 | Japuntich et al. |
| 2004/0078860 | A1 | 4/2004 | Bell et al. |
| 2006/0130841 | A1 | 6/2006 | Spence et al. |
| 2006/0162048 | A1 | 7/2006 | Blutstein |
| 2008/0076208 | A1 | 3/2008 | Wu et al. |
| 2009/0211968 | A1 | 8/2009 | Ho et al. |

(Continued)

OTHER PUBLICATIONS

ISA/US, International Search Report and Written Opinion in PCT International Application No. PCT/US17/63118 dated Feb. 5, 2018.

*Primary Examiner* — Richale L Quinn
(74) *Attorney, Agent, or Firm* — Matthew J. Spark; Stefan J. Kirchanski; Zuber Lawler & Del Duca LLP

(57) ABSTRACT

A mask for protecting a head with a face having a nose, mouth, and chin. The mask includes a mask module. The mask module includes an exterior surface and an interior surface. The mask module is sized and shaped to cover a portion of the face. A head module engages the mask module. The head module is configured to engage at least a portion of a user's head.

18 Claims, 23 Drawing Sheets

(56) References Cited

U.S. PATENT DOCUMENTS

| | | | |
|---|---|---|---|
| 2012/0167891 | A1 | 7/2012 | Smaller |
| 2014/0202469 | A1 | 7/2014 | Smaller |
| 2016/0015098 | A1 | 1/2016 | Conlon et al. |

MODULAR FACE MASK

BACKGROUND

The present invention relates generally to face masks. More particularly, the present invention relates to a face mask having modular features.

Many occupational and recreational activities expose individuals to cold weather conditions varying from mild to extreme. Face masks have been developed with the intention to keep a wearer's face protected from adverse cold weather conditions including rain, snow, wind or the like.

While different types of face mask have been proposed for cold weather protection, such face masks have their limitations and can always be improved.

Accordingly, there is a need for an improved face mask for cold weather protection. There is also a need for a face mask having modular features. There is a further need for a face mask that is a waterproof/water resistant. There is an additional need for a face mask made from breathable material. There is a still further need for a face mask made from a material that possesses wicking and anti-microbial properties. There is a need for a face mask that is odor-free. There is an additional need for a face mask that is easier to manufacture, assemble, adjust, and maintain. The present invention satisfies these needs and provides other related advantages.

SUMMARY

A face mask described herein provides for cold weather protection. A face mask described herein includes modular features. A face mask described herein is waterproof/water resistant. A face mask described herein is made from breathable material. A face mask described herein is made from a material that possesses wicking and anti-microbial properties. A face mask described herein is odor-free. A face mask described herein is easier to manufacture, assemble, adjust, and maintain.

In one embodiment, a mask for protecting a head with a face having a nose, mouth, and chin, includes a mask module formed of a material. The mask module includes an exterior surface and an interior surface. The mask module is sized and shaped to cover a portion of the face.

The mask module further includes an adjustable upper portion, a middle portion, and a lower portion. The upper portion conforms to at least a portion of the nose. The middle portion includes a multi-layer mouthpiece and a plurality of pleats disposed on opposite sides of the mask module. The pleats provide an accordion-effect in the material of the mask module that defines a space between the interior surface of the mask module and at least the mouth when the mask is worn over the face.

A head module engages the mask module. The head module is configured to engage at least a portion of a head.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The various present embodiments now will be discussed in detail with an emphasis on highlighting the advantageous features with reference to the drawings of various embodiments. The illustrated embodiments are intended to illustrate, but not to limit the invention. These drawings include the following figures, in which like numerals indicate like parts.

DETAILED DESCRIPTION

Figure 1:
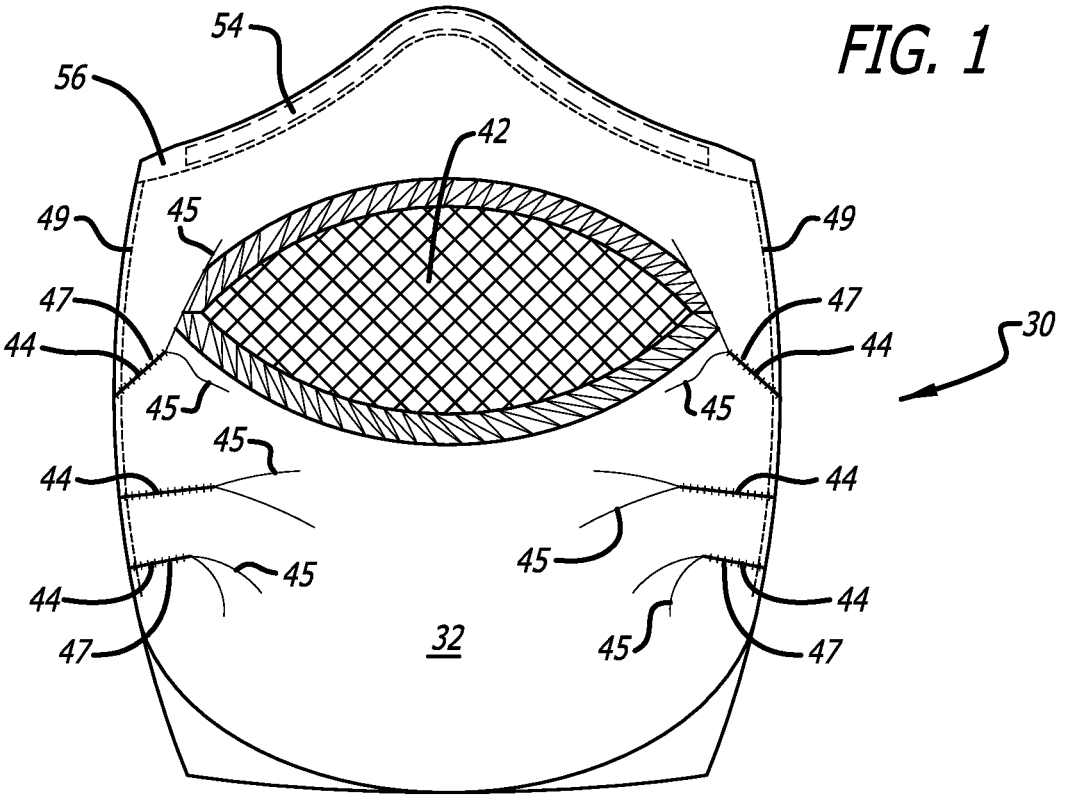
FIG. 1 is a front view of a mask module embodying the invention.

The following detailed description describes present embodiments with reference to the drawings. In the drawings, reference numbers label elements of present embodiments. These reference numbers are reproduced below in connection with the discussion of the corresponding drawing features.

In FIGS. 1-24, a modular mask member or mask module 30 is shown, for purposes of illustration, incorporated into various embodiments of stylish, aesthetically pleasing protective face masks 100, 200, 300, 400, 500, 600. The mask module 30 is in engagement with a modular head member or head module 110, 210, 310, 410, 510, 610 to provide an article of clothing that protects at least a user's face (including at least the wearer's nose, mouth, and chin), if not at least a portion of the rest of their head as well. The head module 110, 210, 310, 410, 510, 610 is configured to engage at least a portion of the user's head. The mask module 30 is operationally connected (i.e., attached by various methods) to the head module 110, 210, 310, 410, 510, 610. The mask module 30 is designed to be versatile to work with a variety of face mask styles where the user's mouth, nose, and chin are protected from the environment. The engagement of the mask 30 and head 110, 210, 310, 410, 510, 610 modules comprises at least one of a module mask 100, a full mask 200, a full mask with neck warmer 300, a balaclava mask 400, 500, and a bandana mask 600. The face mask 100, 200, 300, 400, 500, 600 is sized and shaped to snugly cover a portion of the user's head.

The mask module 30 and any particular head module 110, 210, 310, 410, 510, 610 are made as separate components and then subsequently integrally connected together. The mask module 30 may be fixedly connected to the head module 110, 210, 310, 410, 510, 610 by, for example, sewing the mask module 30 and the head module 110, 210, 310, 410, 510, 610 together. The mask 30 and head 110, 210, 310, 410, 510, 610 modules may be sewn together using flatseam construction to minimize bulky seams between the mask 30 and head 110, 210, 310, 410, 510, 610 modules. The flatseam construction eliminates multiple layers at the seams between the mask 30 and head 110, 210, 310, 410, 510, 610 modules in order to provide the user with a more comfortable, non-irritable fit.

Alternatively, the mask module 30 may be fixedly connected to the head module 110, 210, 310, 410, 510, 610 by chemicals, such as glues or adhesives. In another alternative, the mask module 30 may be removably connected to the head module 110, 210, 310, 410, 510, 610 by mechanical fasteners (e.g., hook and loop fasteners (e.g., VELCRO fasteners), zippers, pins, clips, latches, straps, hook and eye fasteners, toggle fasteners, snaps (male and female), buttons and button holes, straps and buckles, any type of male/female engaging fasteners, or the like), magnetic fasteners or the like. When the mask module 30 is removably connectable to the head module 110, 210, 310, 410, 510, 610, the mask module 30 can be part of a kit comprising a single mask module 30 and one or more head modules 110, 210, 310, 410, 510, 610 so that a user may switch out and use whichever type of head module 110, 210, 310, 410, 510, 610 the user desires to use at that time, depending on the user's mood, weather conditions, other headgear the user would like to wear, and the like. In the alternative, the mask module 30 may be unitarily formed as a single piece construction with the head module 110, 210, 310, 410, 510, 610.

Figure 2:
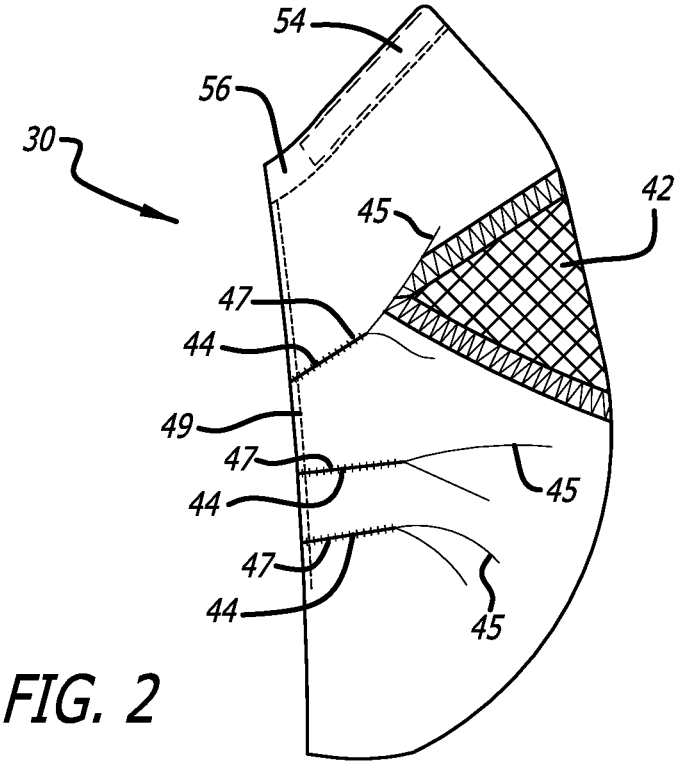
FIG. 2 is a side view of the mask module of FIG. 1.
Figure 3:
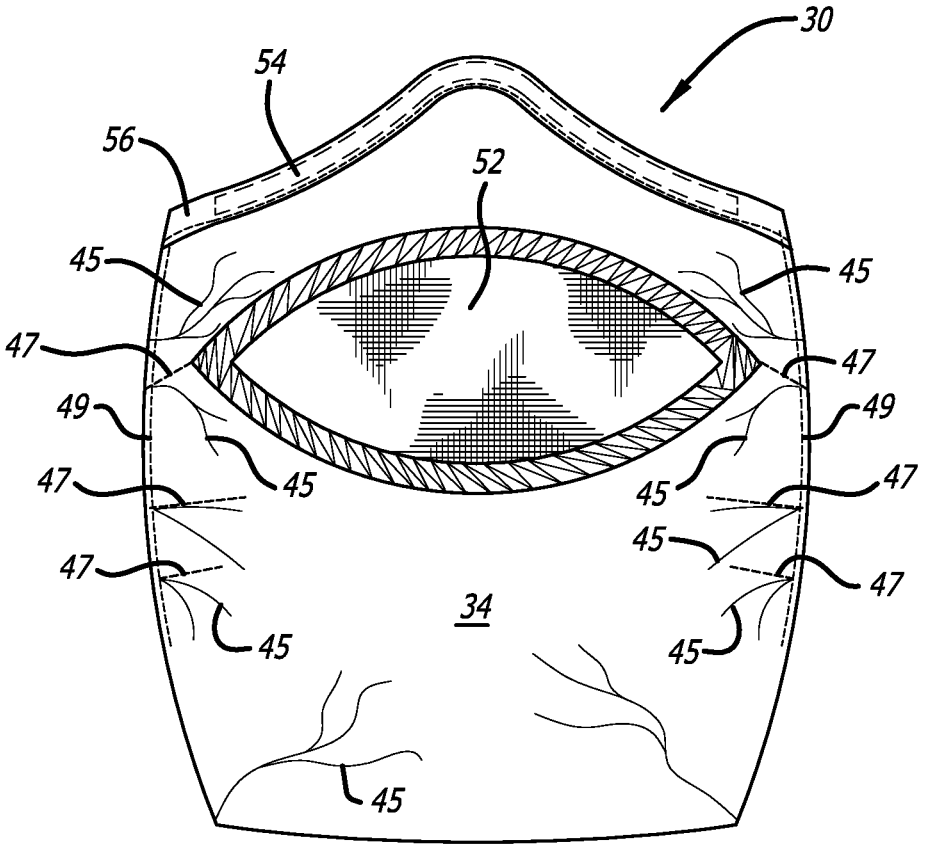
FIG. 3 is a rear view of the mask module of FIG. 1.
Figure 4:
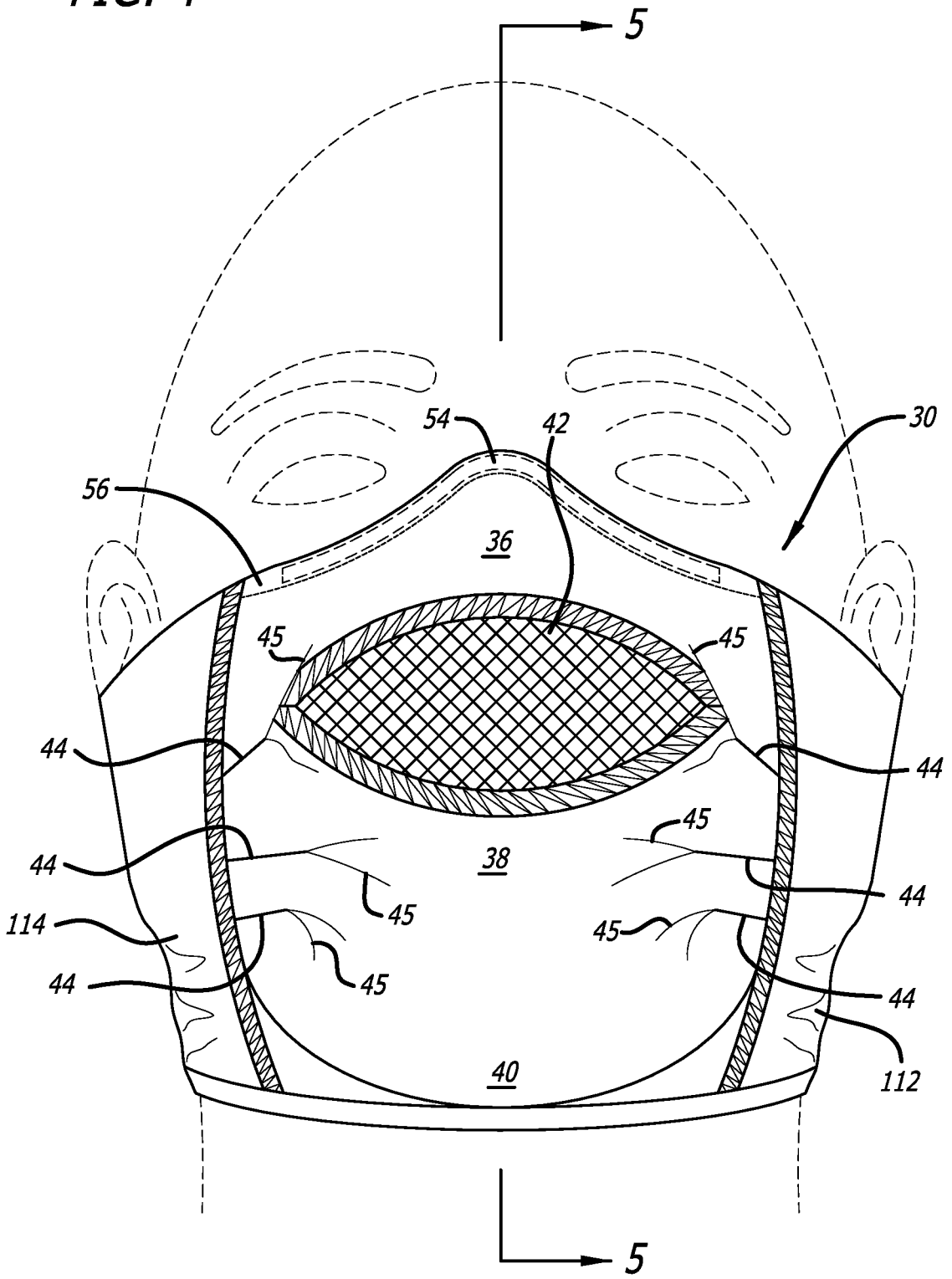
FIG. 4 is a front view of a face mask embodying the present invention, as seen when worn by a user.
Figure 5:
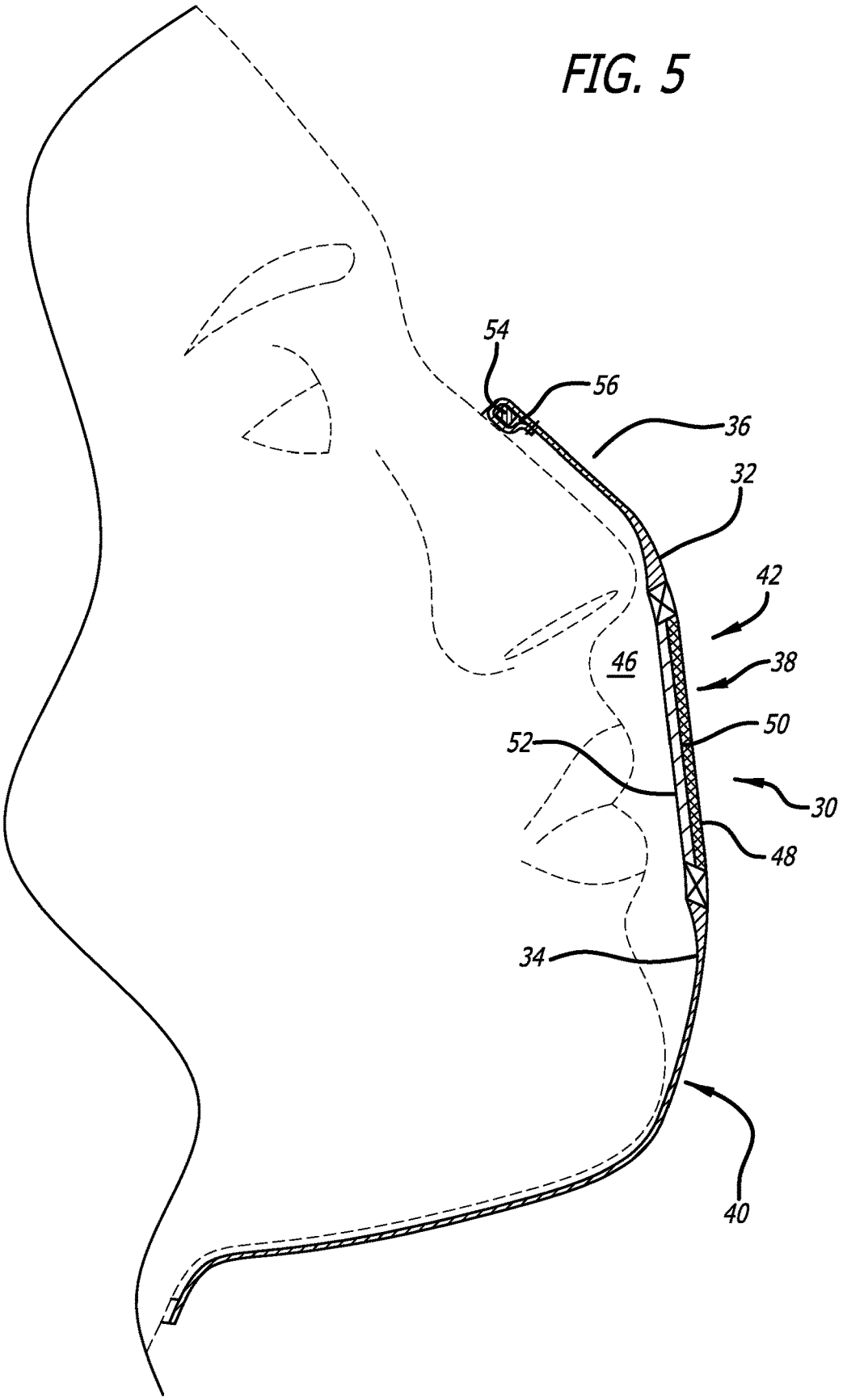
FIG. 5 is a cross-sectional side view of the face mask of FIG. 4, taken along line 5-5 of FIG. 4.
Figure 6:
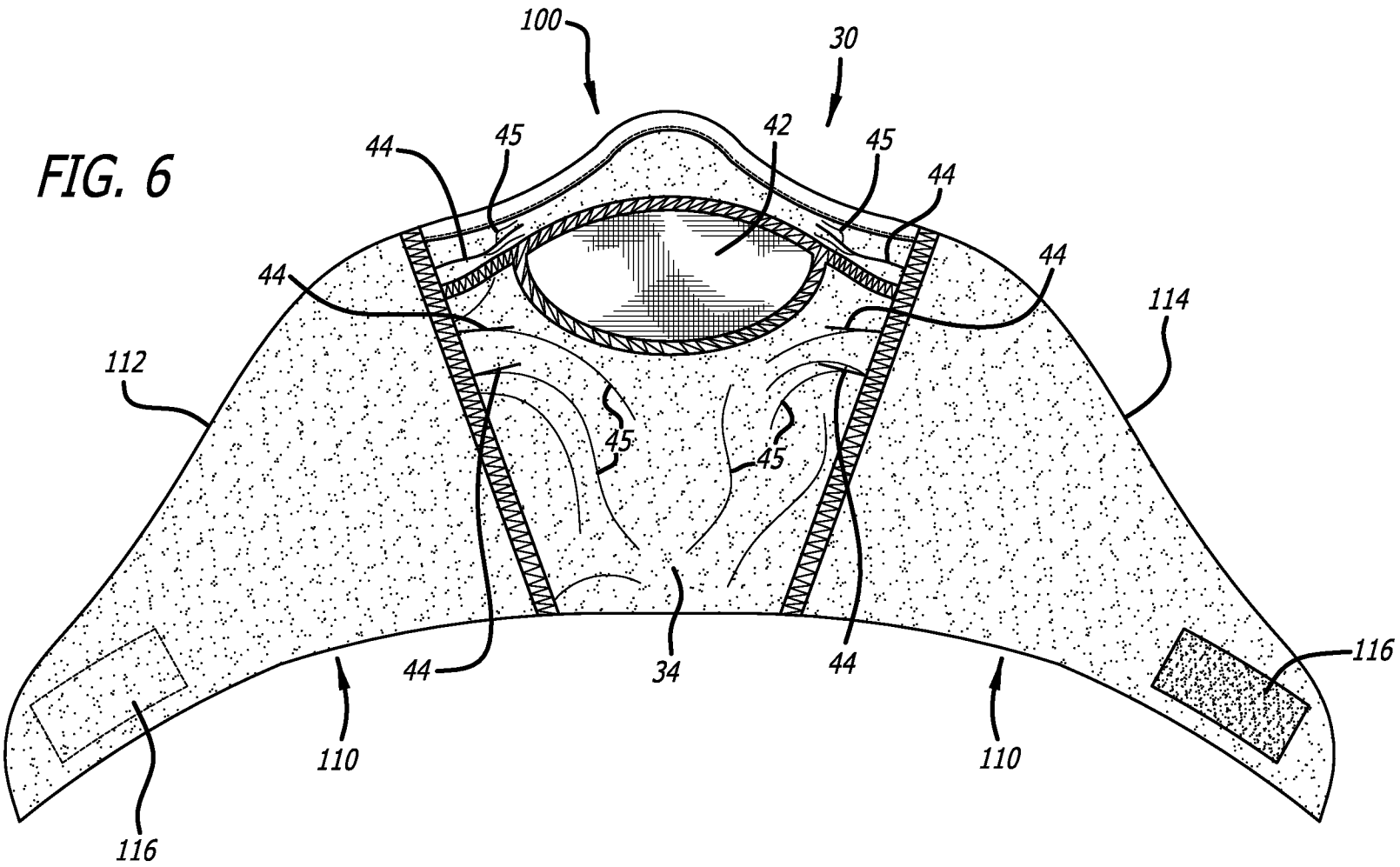
FIG. 6 is a rear view of the face mask of FIG. 4, as seen by itself.
Figure 7:
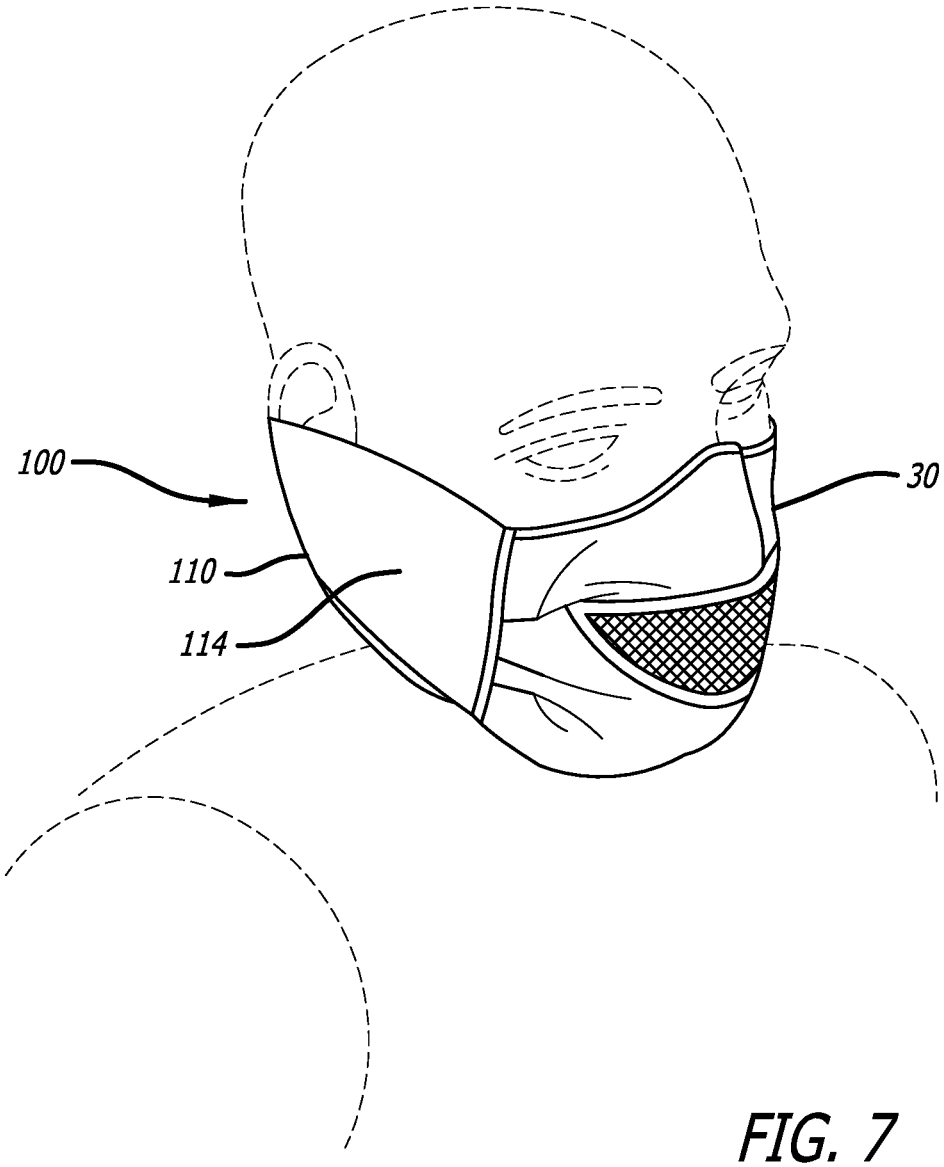
FIG. 7 is a perspective view of the face mask of FIG. 4.
Figure 8:
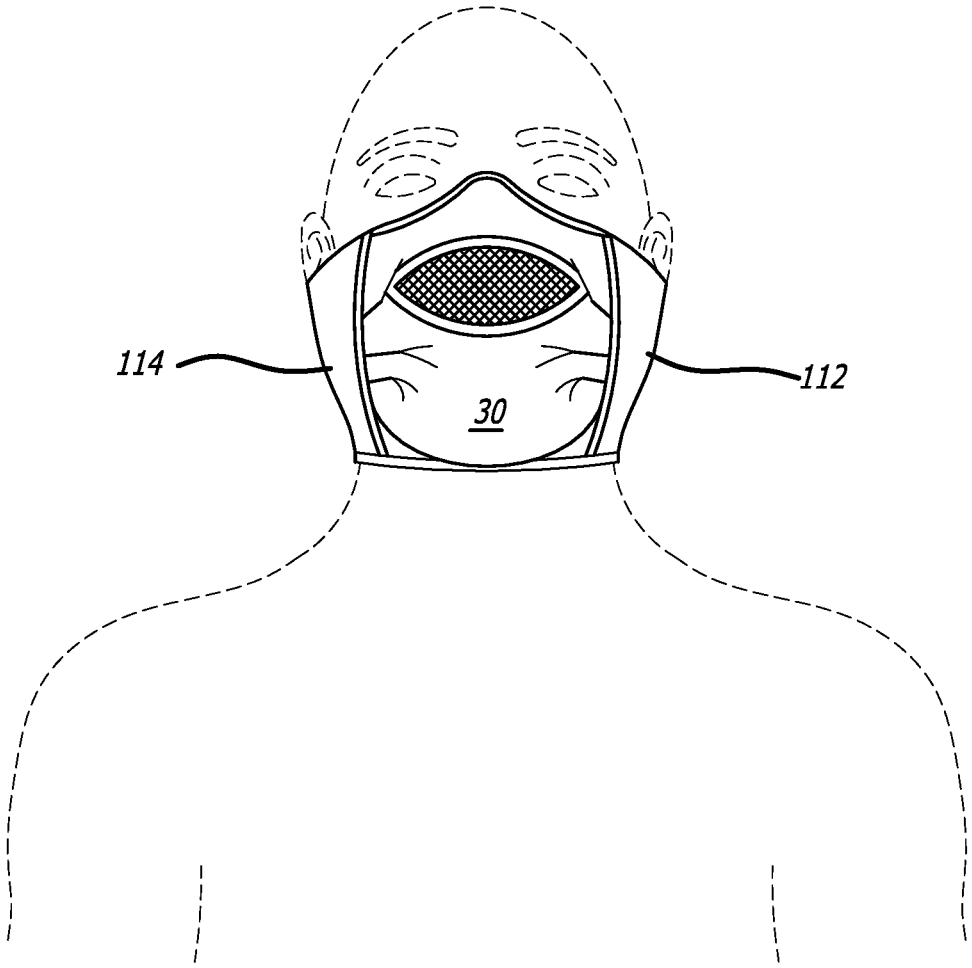
FIG. 8 is another front view of the face mask of FIG. 4.
Figure 9:
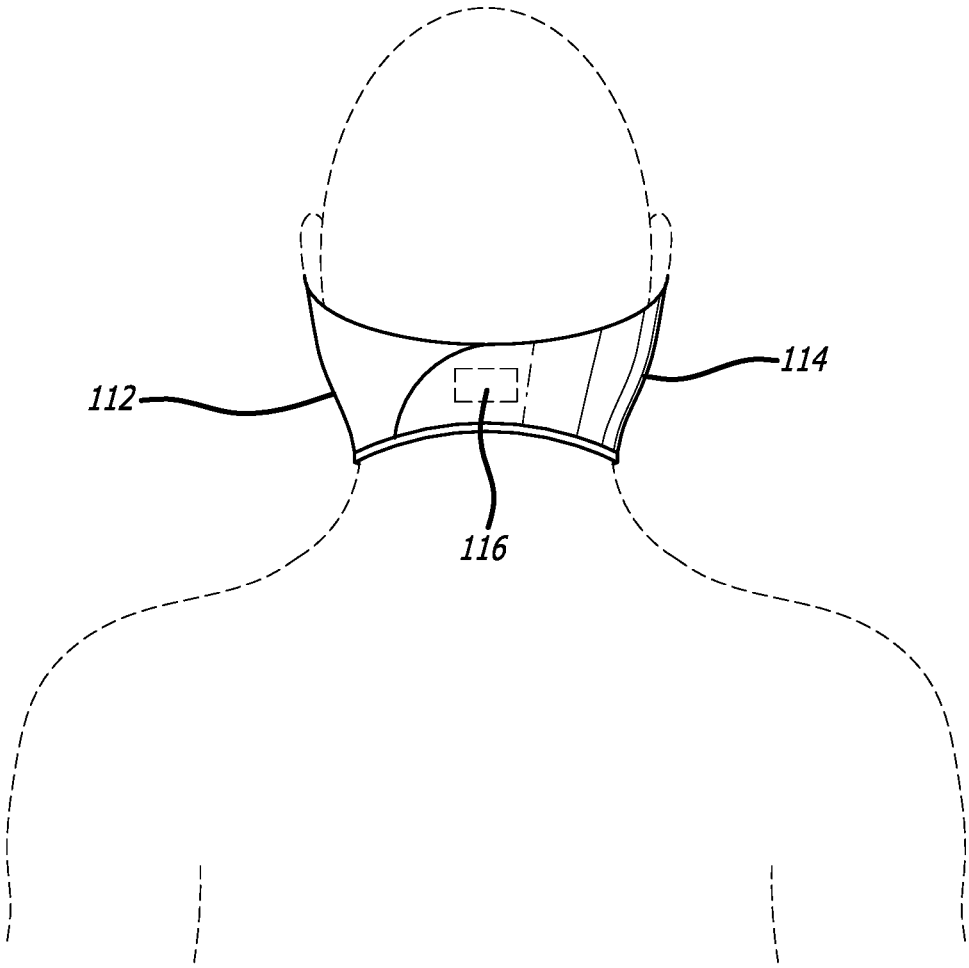
FIG. 9 is another rear view of the face mask of FIG. 4, as seen when worn by a user.

As seen in FIGS. 1-3, the mask module 30 has an exterior surface 32 and an interior surface 34. In use, the mask module 30 is sized and shaped to cover a lower portion of a human face; the mask module 30 extending under the user's chin towards the user's throat, completely covering the user's mouth, covering most of the user's nose, and covering at least a portion of the user's upper and lower cheeks.

The mask module 30 includes an adjustable upper portion 36, a middle portion 38, and a lower portion 40. The middle portion 38 includes a multi-layer mouthpiece module or mouthpiece 42 generally aligned with a user's mouth. The mask module 30 also includes a plurality of pleats 44 in the fabric of the mask module 30. The pleats 44 are formed by stitching together lateral folds in portions of the material of the mask module 30 towards the sides of the mask module 30. The pleats 44 are disposed on opposite sides of the mask module 30. The pleats 44 may be located mostly in the middle portion 38 but pleats 44 may be also disposed in the middle to lower part of the upper portion 36 as well as in the upper to middle part of the lower portion 40. The pleats 44 provide a three-dimensional shape to the user's mouth/nose/chin area as this allows the user to have coverage from the bridge of the user's nose to under the user's chin for fit and comfort. The pleats 44 encapsulate the area using an accordion-effect in the material of the mask module 30 created by the pleats 44. The accordion-effect in the material defines a vestibule or space 46 between the interior surface 34 of the mask module 30 and at least the user's mouth when the mask 100, 200, 300, 400, 500, 600 is worn over the user's face. The air within the space 46 and the user's mouth/nose/chin area is generally warmer than air external to the mask module 30, and the space 46 defined by the pleats 44 allows for free movement of the user's mouth and chin so the mask does not substantially move due to the opening and closing motion of the user's mouth while speaking, and maintaining the mask module 30 substantially in place on the user's face. The size and location of the pleats 44 may produce folds 45 in the material of the mask module 30.

The mask module 30 and the head module 110, 210, 310, 410, 510, 610 may be made from various materials. All face masks 100, 200, 300, 400, 500, 600 are designed with protection and warmth as the priority. However, the materials used depend on the mask 100, 200, 300, 400, 500, 600 being used in cold and extreme elements/conditions or in less extreme conditions. Regardless of the external environmental conditions, the fabrics used in the mask module 30 have moisture movement properties that move the moisture away from the user's head and neck to the outer layer of fabric so the moisture can be dispersed/evaporated. At least a portion of the mask module 30 is made of the same material as at least a portion of the head module 110, 210, 310, 410, 510, 610. Alternatively, at least a portion of the mask module 30 is made of a material different from that of at least a portion of the head module 110, 210, 310, 410, 510, 610.

In cold and extreme elements/conditions, an embodiment of the mask module 30 can be made from a material that comprises a waterproof/breathable fabric having wicking and anti-microbial properties. For example, the material can comprise a 100% polyester, three-layer fabric that includes a waterproof/breathable middle membrane (i.e., moisture vapor moves through it). The outer layer of the material, comprising the exterior surface 32 of the mask module 30, can have a smooth knit face with a durable water repellent finish that repels moisture and decreases dry times. The durable water repellent fabric finish keeps the outer fabric of the mask module 30 from becoming saturated with moisture. The durable water repellent fabric finish keeps moisture/snow off the outer (face) fabric so the moisture/snow does not accumulate. In general, it is beneficial to keep the outer fabric of the mask module 30 dry. The middle membrane allows the face mask 100, 200, 300, 400, 500, 600 to breathe while preventing moisture from contacting the user's skin. The inner layer of the material, disposed on the interior surface 34 of the mask module 30, can have a fleeced surface for softness and comfort. The fleeced surface can prevent the user's skin from becoming irritated by movement of the mask 100, 200, 300, 400, 500, 600.

In less extreme (but still cold) conditions, an embodiment of the mask module 30 can be made from a material that comprises an insulating/breathable fabric having wicking and anti-microbial properties, and has a lighter weight construction than the material used for cold and extreme conditions. For example, the material can comprise 89% polyester/11% spandex fabric having a single layer of knitted yarns with a smooth face and a fleeced back. The outer surface of the material, comprising the exterior surface 32 of the mask module 30, includes a smooth knit face with a hydrophobic treatment to repel or push away moisture and decreases dry times. In general, it is beneficial to keep the outer fabric of the mask module 30 dry. The inner surface of the material, comprising the interior surface 34 of the mask module 30, can have a fleeced surface for softness and comfort. The fleeced surface can prevent the user's skin from becoming irritated by movement of the mask 100, 200, 300, 400, 500, 600. Mask modules 30, regardless of the harshness of external weather conditions, can include materials that include moisture management yarns, and antimicrobial treatment (silver-based or the like) for odor-control.

The mouthpiece 42 comprises an outer material layer 48, a middle spacer layer 50, and an inner material layer 52. The mouthpiece 42 prevents direct ingress of incoming air, with the outer material layer 48 deflecting and diffusing incoming air. The middle spacer layer 50 traps air for added thermal benefit, providing an air trap that warms air coming into the mask module 30 from the external environment. In cold and extreme elements/conditions, the mouthpiece 42 can be made from a 100% polyester, 3D spacer fabric with an open mesh material outer face layer 48, a spacer middle lawyer 50, and a knitted material back layer 52. The fabric can be made of yarn having various properties, including antimicrobial (e.g., silver technology for antimicrobial management (e.g., A.M.Y.® antimicrobial yarn; Huntsman Pure by HeiQ)) and moisture management properties (e.g., Sorbtek® moisture management yarn). For example, when manufacturing a yarn, when the polymer is extruded, a powder (additive) having anti-microbial properties can be added so the anti-microbial function is inherent in the yarn. A mask module 30 and a head module 110, 210, 310, 410, 510, 610 incorporating an antimicrobial textile effect makes it possible to keep the face mask 100, 200, 300, 400, 500, 600 odor-free (or at least reduced odor) by inhibiting the growth of odor-causing bacteria. In another example, moisture management can be achieved by the sizes and shapes of yarns used in the mesh fabric materials. The weight of the mesh material of the outer face layer 48 can be approximately 8.2 oz/yd2. In less extreme conditions, the mouthpiece 42 can have a similar construction but the outer face layer 48 uses a lighter weight of mesh fabric material (e.g., approximately 4.5 oz/yd2). Regardless of the external environmental conditions, the mesh fabrics used in the mouthpieces 42 work with a push-pull knit pattern function that pushes away and pulls toward (i.e., the layer or side of the fabric against the face will push and the side of the fabric or layer toward the outside will pull it) in order to expedite moisture transfer as well as enable exceptional airflow for optimal breathability.

The mouthpiece 42 is permanently connected to the mask module 30 (e.g., sewn together using flatseam construction), and provides breathing/ventilation by "mixing the air" or "circulating" the incoming fresh air entering the mask module 30 from the external environment. Alternatively, the mouthpiece 42 may be removably connected to the mask module 30 by mechanical fasteners (e.g., hook and loop fasteners (e.g., VELCRO fasteners), zippers, pins, clips, latches, straps, hook and eye fasteners, toggle fasteners, snaps (male and female), buttons and button holes, straps and buckles, any type of male/female engaging fasteners, or the like), magnetic fasteners or the like. Removably connecting the mouthpiece 42 to the mask module 30 allows the user to switch between different types of mouthpiece (e.g., extreme condition mouthpiece, less extreme condition mouthpiece) or wear the mask module 30 without the mouthpiece 42. The construction of the mouthpiece 42 prevents a user from directly breathing the outside cold air directly into the user's mouth, throat, lungs, and bronchi. By deflecting and diffusing incoming fresh, external air and circulating that fresh air as comes into the mask module 30, the mouthpiece 42 prevents direct cold, harsh wintery air from irritating the user's mouth, throat, and lungs, and subsequent irritation and damage to the user's bronchi. The incoming air is circulated and/or broken up by the mouthpiece 42 as the air enters the mask module 30 on inhalation, with the mouthpiece 42 providing comfort and protection to the user.

The upper portion 36 of the mask module 30 is conformable to at least a portion of the user's nose. The upper portion includes a flexible band 54 disposed within a pocket 56 formed at the upper edge of the upper portion 36. Alternatively, the band 54 can be disposed between layers of the material of the mask module 30. The band 54 can be positioned between mesh and elastic layers for padding (comfort) and to protect the band 54 from coming through the fabric. The band 54 is pliable and conformable to at least a portion of the user's nose. The band 54 provides the upper portion 36 with a flexible nose bridge portion. The band 54 can be made of various flexible, pliable materials that retain the shape the material is bent into including, without limitation, a soft metal, an aluminum alloy, a copper alloy, sheet metal, a silver alloy, composite materials, titanium, and the like. The band 54 can also come in various forms including, without limitation, a thin elongated bar, a thin elongated rod, or any thin elongated circular or polygonal shape, and the like. It is preferred that the band 54 has a flat surface on the side facing the user's face in order to avoid any unnecessary pressure on the user's face. Within the pocket 56, the band 54 extends along the upper portion 36 across the face of the user. In this manner, the band 54 not only extends across and rests upon the upper bridge of the user's nose, but also extends and rests upon the upper cheekbones of the user, thereby disbursing the pressure of the entire mask 100, 200, 300, 400, 500, 600 onto a broader surface of the user's face. This dispersion of pressure is unique in that it adjusts easily to the contour of the user's face on any nose bridge and distance between higher facial cheekbones (i.e., under the user's eyes). The band 54 disperses pressure to the user's cheekbones, eliminates any discomfort, and allows the upper portion 36 of the mask module 30 to be contoured to the user's unique face. With the ability to position and shape the band 54, the shape of the upper portion 36 can be adjusted to increase/decrease contact between the mask module 30 and the user's face, thereby adjusting pressure of the mask module 30 on the user's face. Due to the flexibility of the band 54, the shape of the band 54 and generally conforms to contours of the user's face over which the band 54 is disposed. Again, this results in the weight of the mask 100, 200, 300, 400, 500, 600 being generally dispersed on the user's face generally along the length of the band 54. Ends of the band 54 extend in generally opposite directions, away from the user's nose and across the upper cheeks of the user's face. The length of the band 54 depends on the weight of the mask module 30 itself, and the need to disperse pressure of the mask module 30 on the user's face. For example, the mask module 30 for cold and extreme elements/conditions is heavier than the mask module 30 for less extreme conditions. Thus, the length of band 54 for the mask module 30 for cold and extreme elements/conditions is generally longer than the length of the band 54 required the mask module 30 for less extreme conditions. The band 54 for less extreme conditions may have a preferred approximate length that is about the length required to cover the bridge and at least a portion of the sides of the user's nose down to the user's cheek (the length of the band 54 may vary between the length required to cover the bridge of the user's nose to the approximately full width of the mask module 30 at the top-most part of the upper portion 36). The band 54 for cold and extreme conditions may have a preferred approximate length that is about the length of the upper portion 36 of the mask module 30 itself (i.e., just slightly less than the approximately full width of the mask module 30 at the top-most part of the upper portion 36 so that the band 54 remains contained within the pocket 56). The band 54 for cold and extreme conditions and the band 54 for less extreme conditions may vary in relative length, as described above.

The shape of the upper portion 36 against the user's face can be adjusted to define at least one passage for air to move in or out of the mask. That is, the upper portion 36 of the mask module 30 can be shaped to create small breath holes/vent holes for the passage of air between the interior and exterior of the mask module 30. Thus, the nature of the band 54 also allows the user the ability to not only adjust the pressure points of the upper portion 36 of the mask module 30 on the user's face, but also to regulate the amount of additional air that can be allowed in or out of the mask module 30. Adjusting the shape of the upper portion 36 also provides the user with the ability to regulate the temperature within the mask module 30, as well as regulate the volume of air that can move in and/or out of the mask module 30. By providing the user with the ability to contour and re-configure the shape of the upper portion 36, the user can individually regulate temperature within the mask, pressure of the mask on the user's face, and air volume moving in and/or out of the mask module 30.

As seen in FIGS. 4-9, a face mask embodying the invention is in the form of a module mask 100 where the mask module 30 engages the head module 110. The head module 110 comprises left and right portions 112, 114 attached to, and extending away from, the mask module 30. The left portion 112 is connected to one side of the mask module 30, and the right portion 114 is connected to the opposite side of the mask module 30. Both the left and right portions 112, 114 are made of the same material as the mask module 30. Alternatively, the left and right portions 112, 114 are made of a material different from that of the material of the mask module 30 (e.g., a 100% polyester fleece fabric) or a mixture of materials (e.g., parts of the left and right portions 112, 114 are made of the same material as the mask module 30 while other parts of the left and right portions 112, 114 are made of a material different from that of the mask module 30). The mask 30 and head 110 modules may permanently connected (e.g., sewn together using flatseam construction to minimize bulky seams between the mask 30 and head 110 modules, chemically connected, etc.) or, in the alternative, removably connected using various fasteners including, without limitation, mechanical fasteners (e.g., hook and loop fasteners (e.g., VELCRO fasteners), zippers, pins, clips, latches, straps, hook and eye fasteners, toggle fasteners, snaps (male and female), buttons and button holes, straps and buckles, any type of male/female engaging fasteners, or the like).

The left and right portions 112, 114 are wrapped around the user's head. Fasteners 116 disposed on the distal ends of the left and right portions 112, 114 matingly engage and hold the module mask 100 snugly on the user's head. The left and right portions 112, 114 cover at least a portion of the user's ears (i.e., depending on the size of the individual user's ears), and hold the mask module 30 snugly to the user's face with the underside of the user's chin and jaw snugly contained by the mask module 30. The fasteners 116 may come in a variety of forms including, without limitation, mechanical fasteners (e.g., hook and loop fasteners (e.g., VELCRO fasteners), zippers, pins, clips, latches, straps, hook and eye fasteners, toggle fasteners, snaps (male and female), buttons and button holes, straps and buckles, any type of male/female engaging fasteners, or the like), magnetic fasteners or the like. In the alternative, the left and right portions 112, 114 are permanently connected (e.g., sewn together using flatseam construction, a single unitary piece of material, or the like) and the material of the left and right portions 112, 114 is resiliently expandable, stretchable to fit around the user's head and secure the module mask 100 in position.

Figure 10:
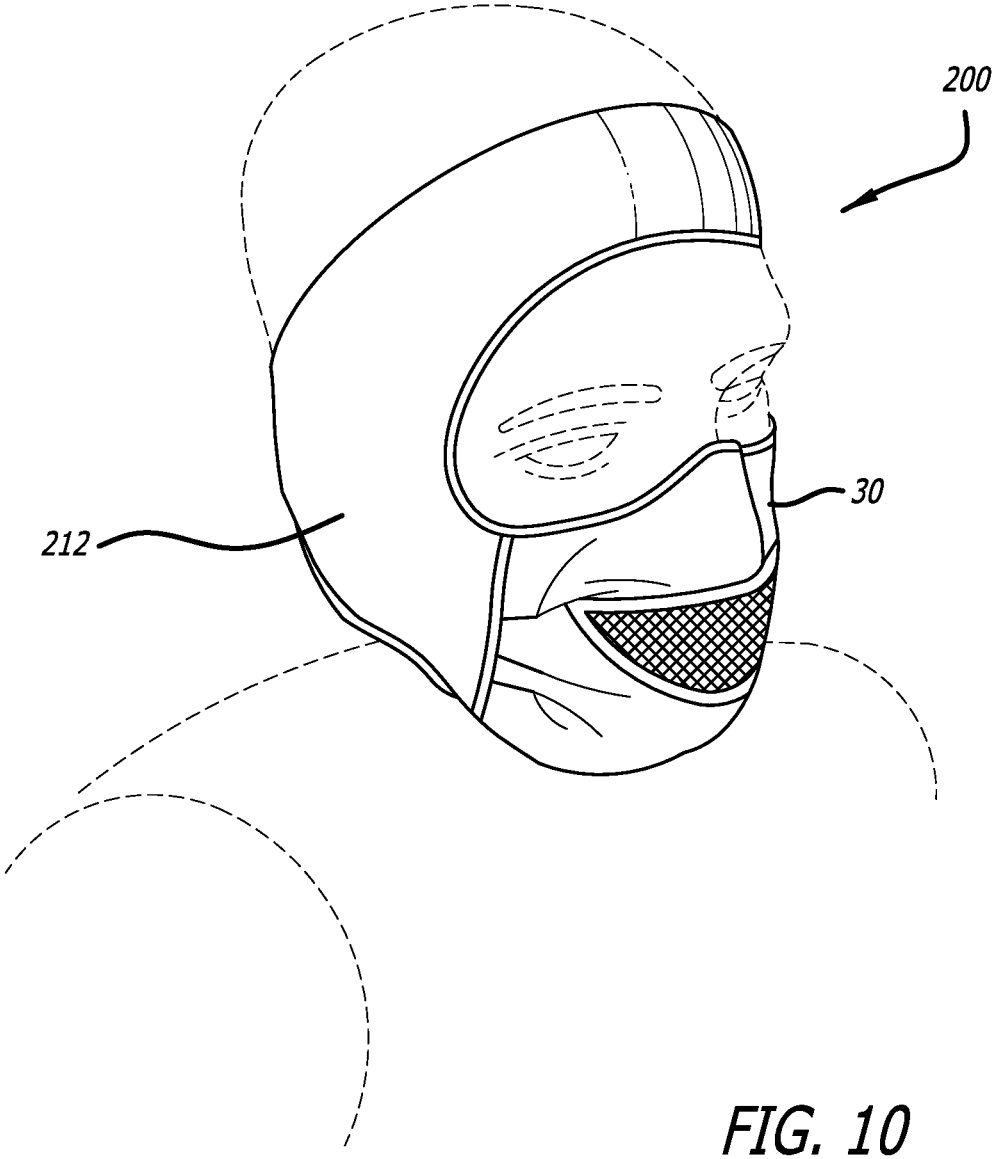
FIG. 10 is a perspective view of another face mask embodying the invention, as worn by a user.
Figure 11:
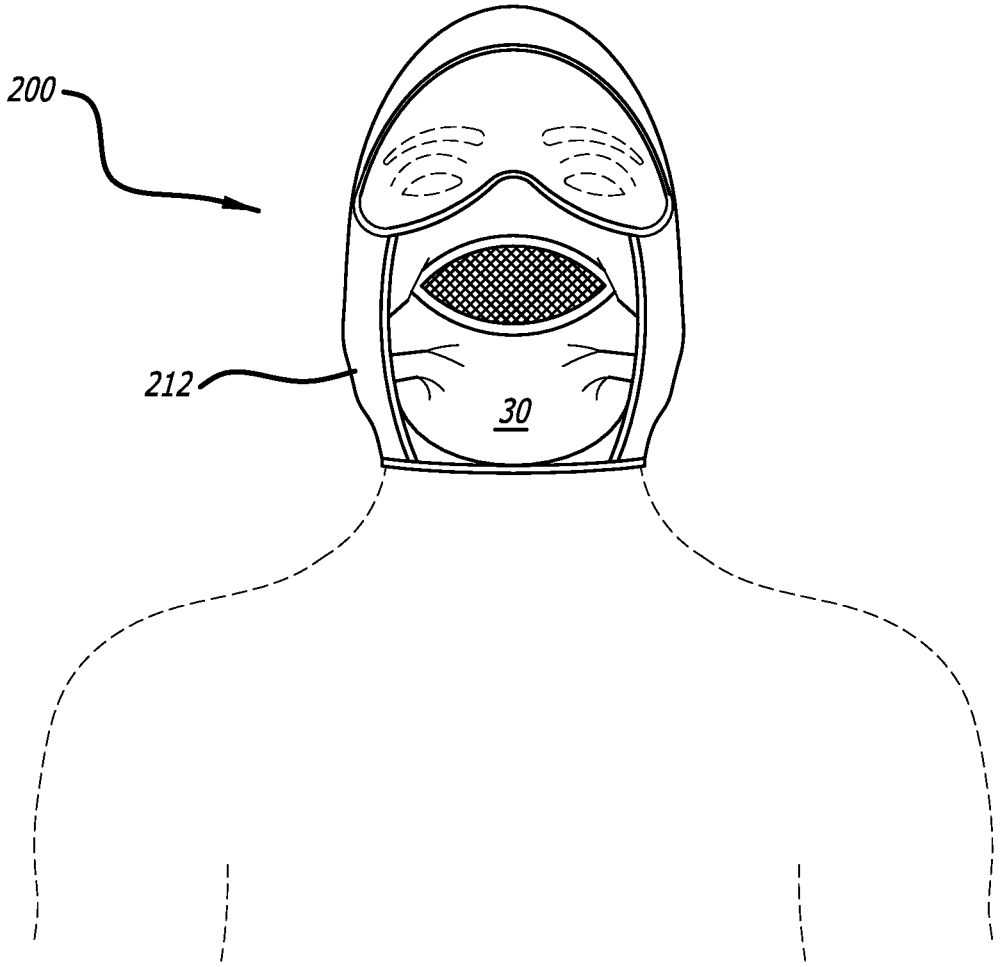
FIG. 11 is a front view of the face mask of FIG. 10.
Figure 12:
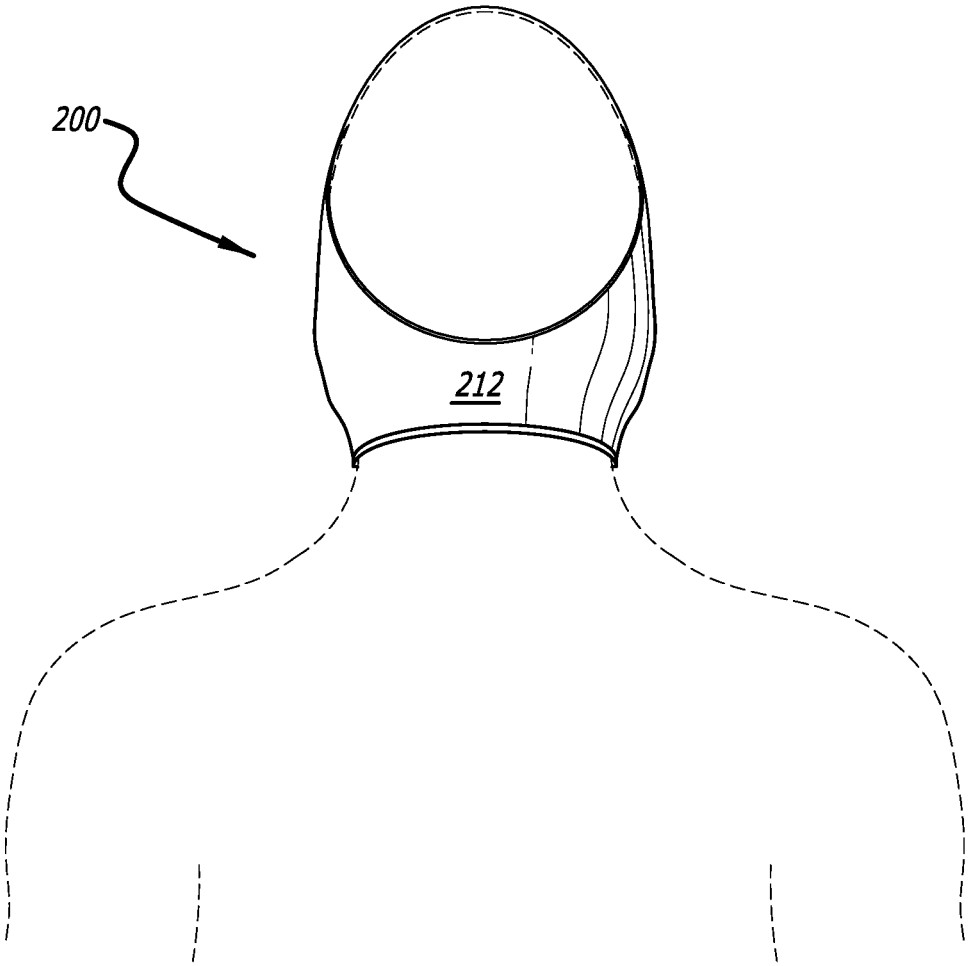
FIG. 12 is a rear view of the face mask of FIG. 10.

As seen in FIGS. 10-12, a face mask embodying the invention is in the form of a full mask 200 where the mask module 30 engages the head module 210. The head module 210 comprises a unitary portion 212 connected to and extending away from the sides of the mask module 30. The unitary portion 212 also extends across the user's middle/upper forehead, leaving uncovered portions of the user's head that includes the top portion of the user's head and the user's eyes. The unitary portion 212 is made of the same material as the mask module 30. Alternatively, the unitary portion 212 is made of a material different from that of the material of the mask module 30 (e.g., a 100% polyester fleece fabric) or a mixture of materials (e.g., parts of the unitary portion 212 are made of the same material as the mask module 30 while other parts of the unitary portion 212 are made of a material different from that of the mask module 30). The mask 30 and head 210 modules may permanently connected (e.g., sewn together using flatseam construction to minimize bulky seams between the mask 30 and head 110 modules, chemically connected, etc.) or, in the alternative, removably connected using various fasteners including, without limitation, mechanical fasteners (e.g., hook and loop fasteners (e.g., VELCRO fasteners), zippers, pins, clips, latches, straps, hook and eye fasteners, toggle fasteners, snaps (male and female), buttons and button holes, straps and buckles, any type of male/female engaging fasteners, or the like).

The unitary portion 212 wraps around the user's head, and holds the full mask 200 snugly on the user's head. The unitary portion 212 covers at least a portion of the user's head, as described above, including the user's ears, and holds the mask module 30 snugly to the user's face with the underside of the user's chin and jaw snugly contained by the mask module 30. The material of the unitary portion 212 is resiliently expandable, stretchable to fit around the user's head and secure the full mask 200 in position.

Figure 13:
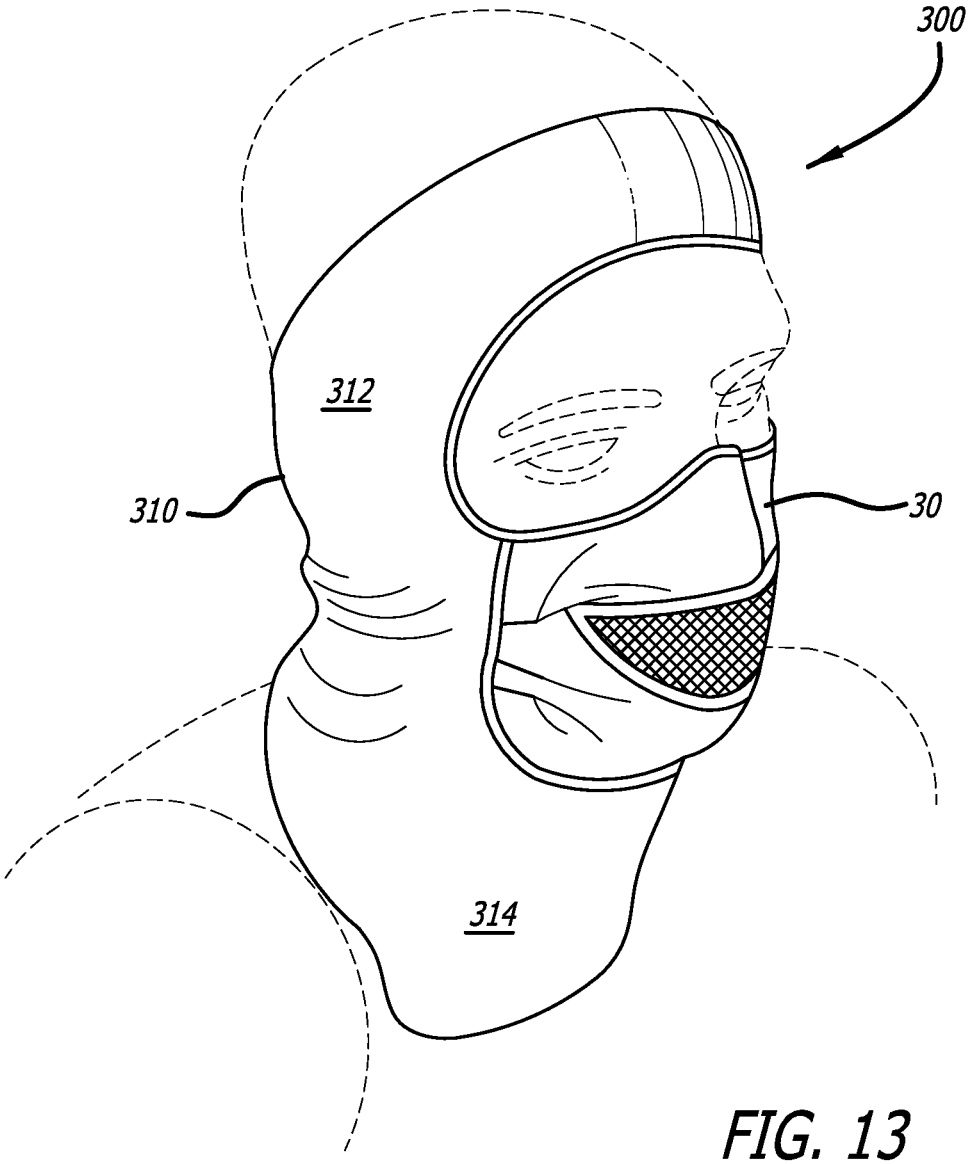
FIG. 13 is a perspective view of yet another face mask embodying the invention, as worn by a user.
Figure 14:
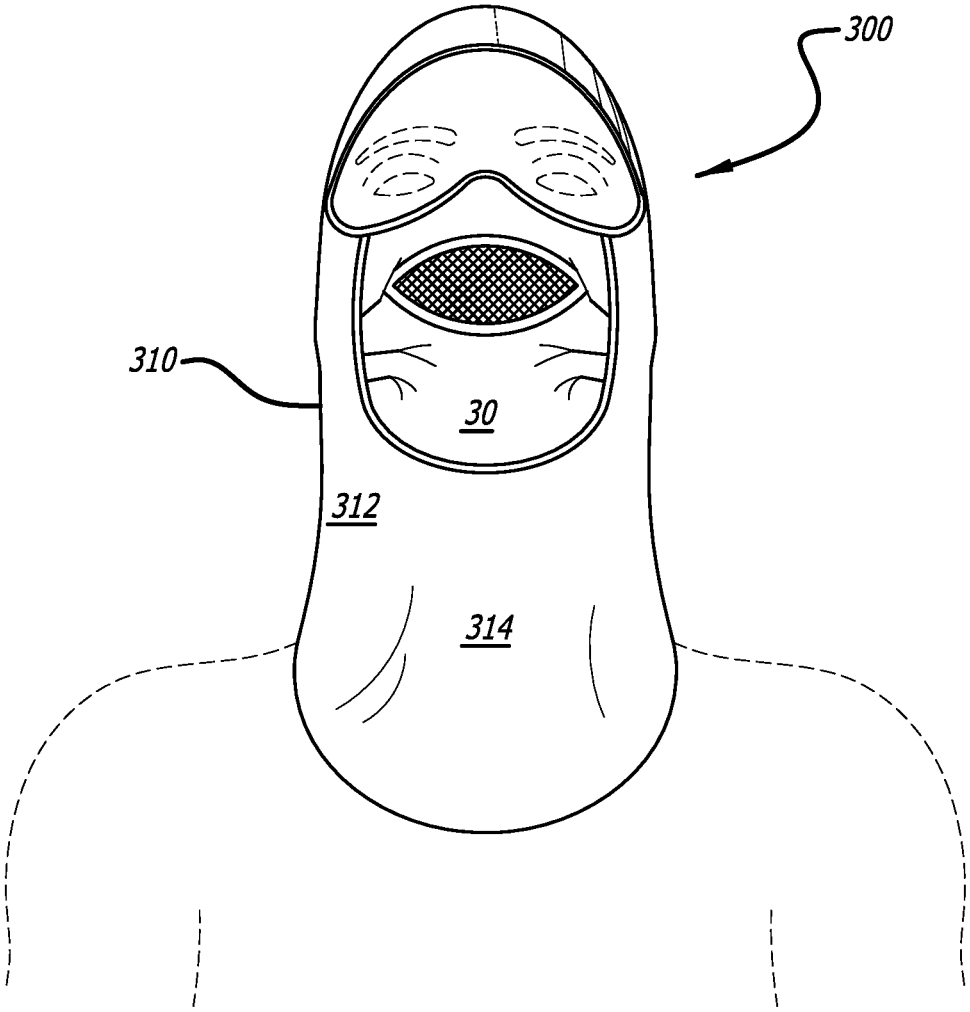
FIG. 14 is a front view of the face mask of FIG. 13.
Figure 15:
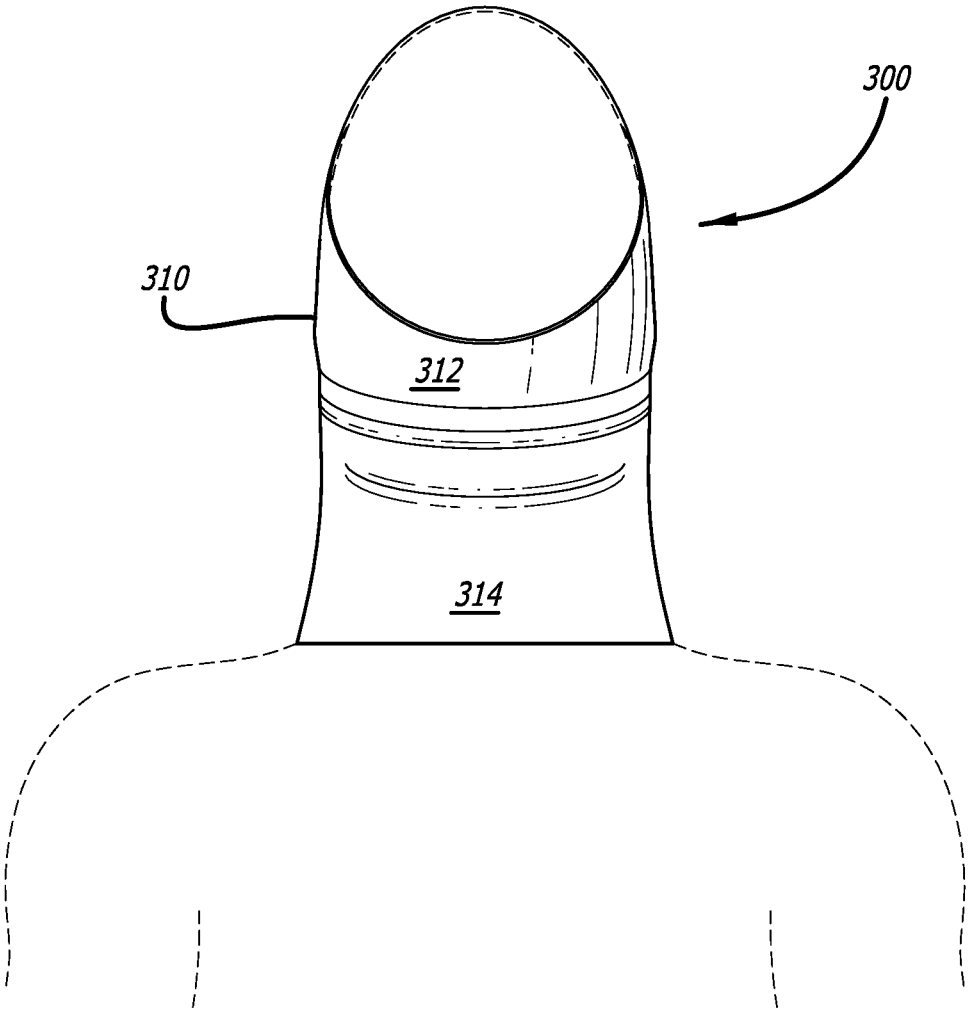
FIG. 15 is a rear view of the face mask of FIG. 13.
Figure 16:
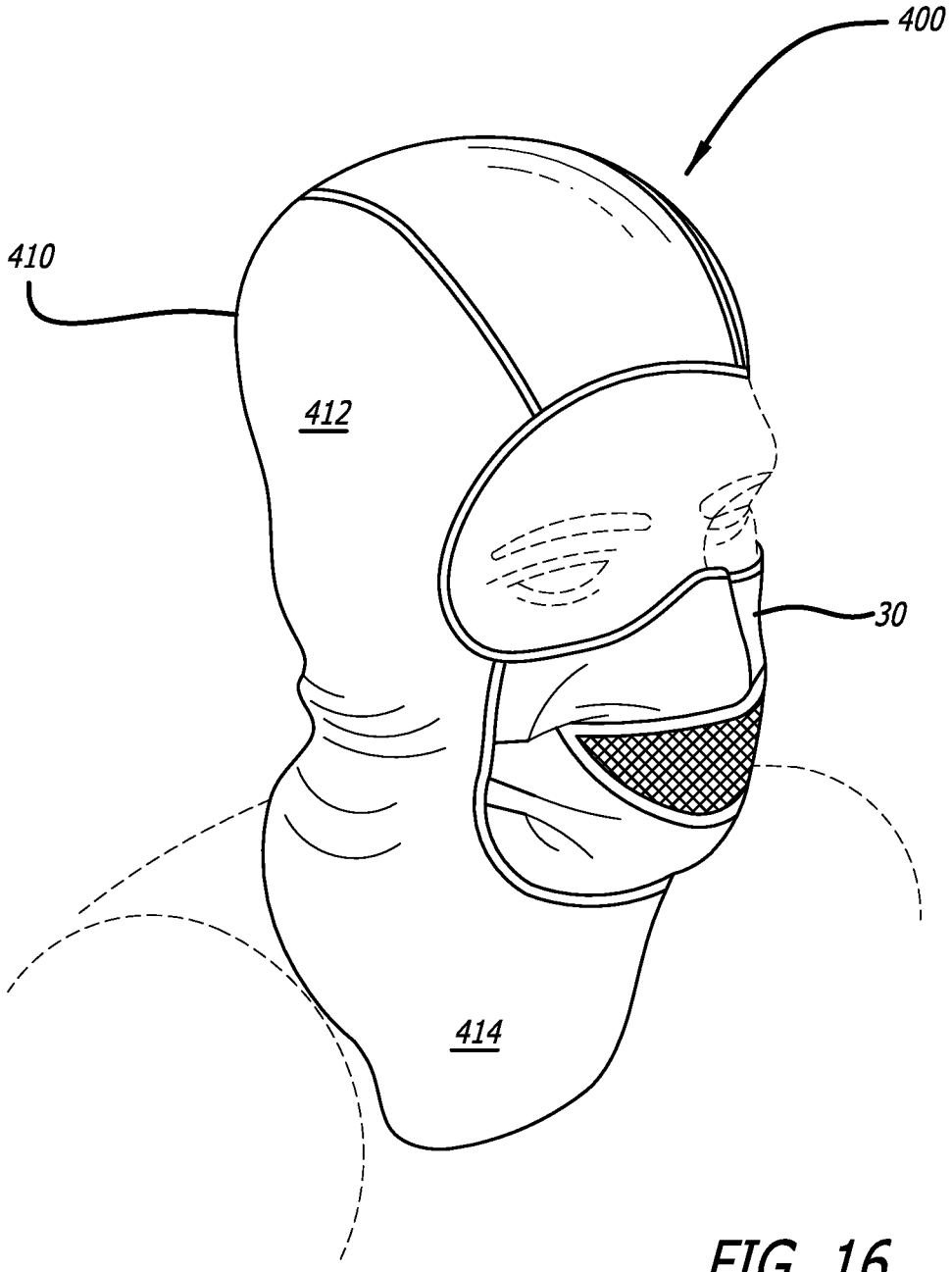
FIG. 16 is a perspective view of an additional face mask embodying the invention, as worn by a user.
Figure 17:
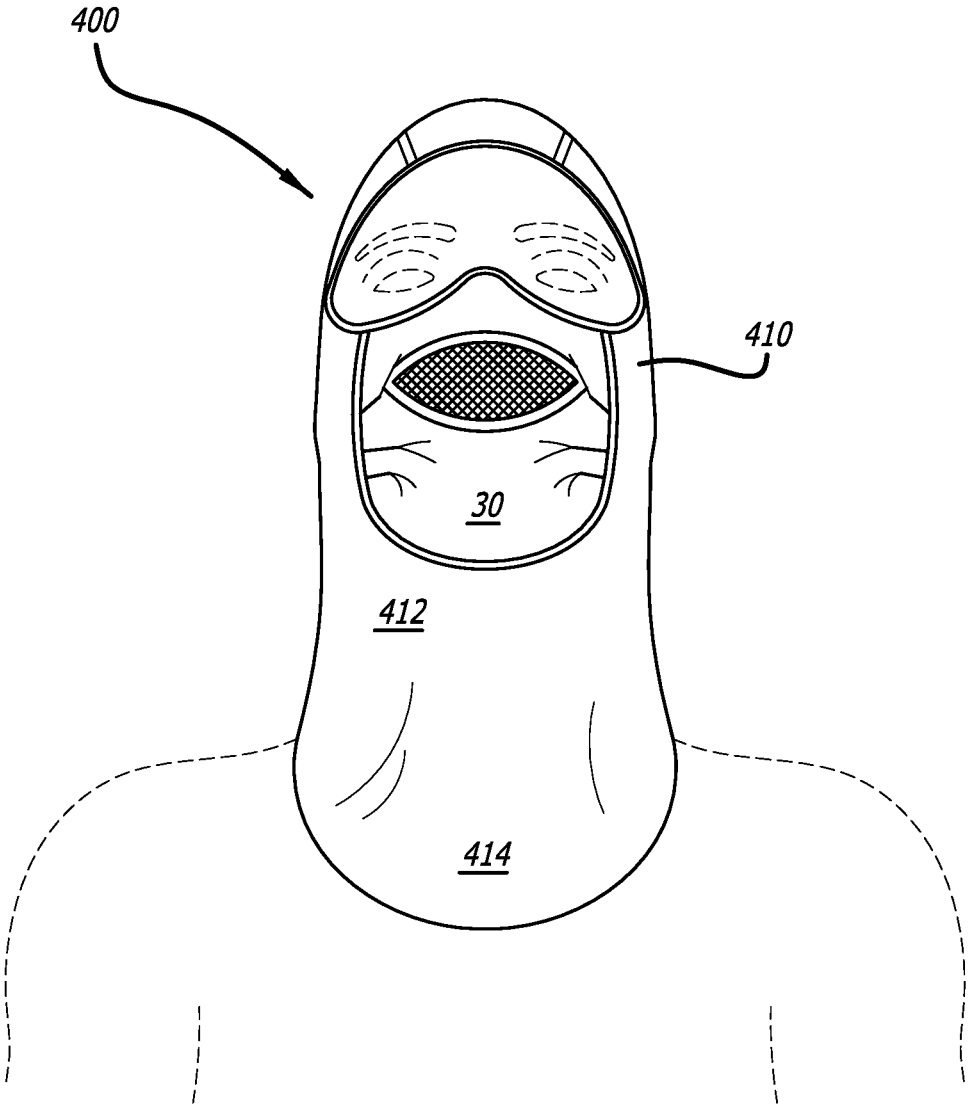
FIG. 17 is a front view of the face mask of FIG. 16.
Figure 18:
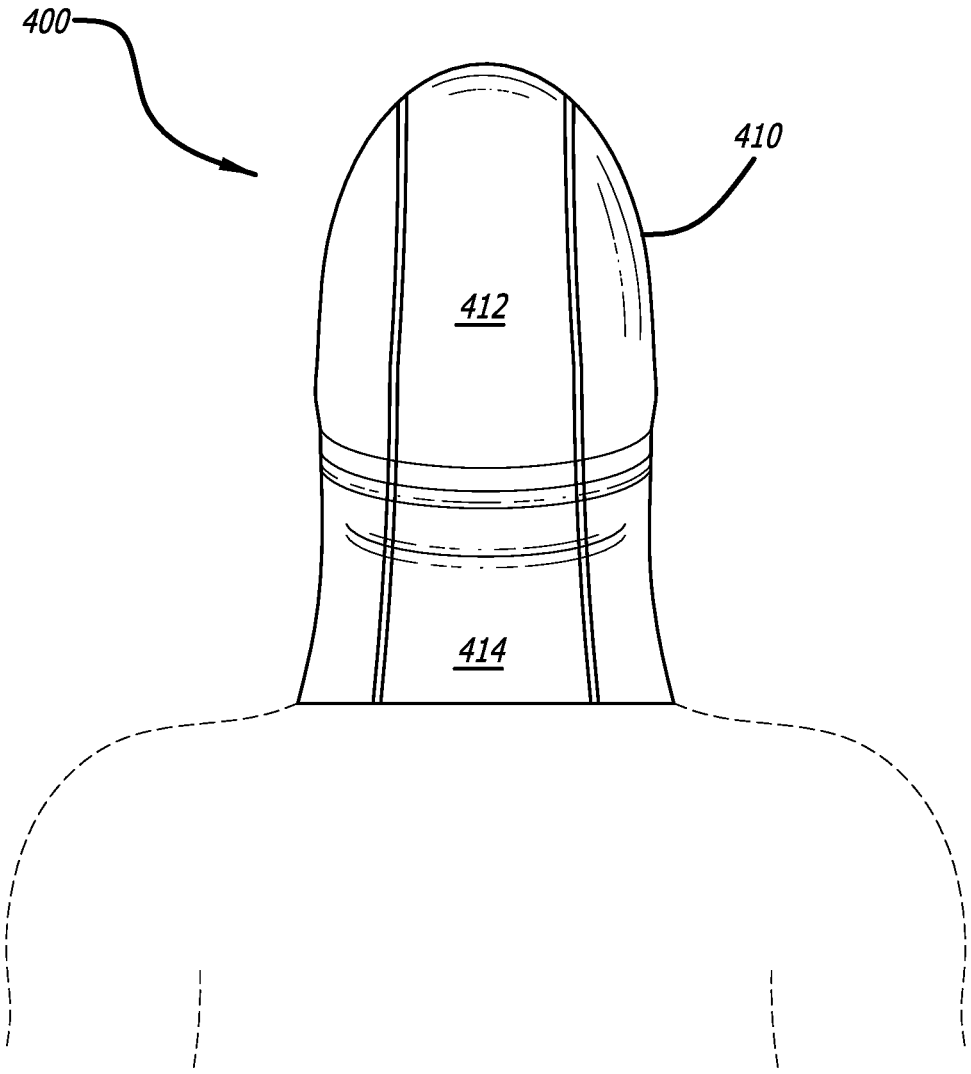
FIG. 18 is a rear view of the face mask of FIG. 16.
Figure 19:
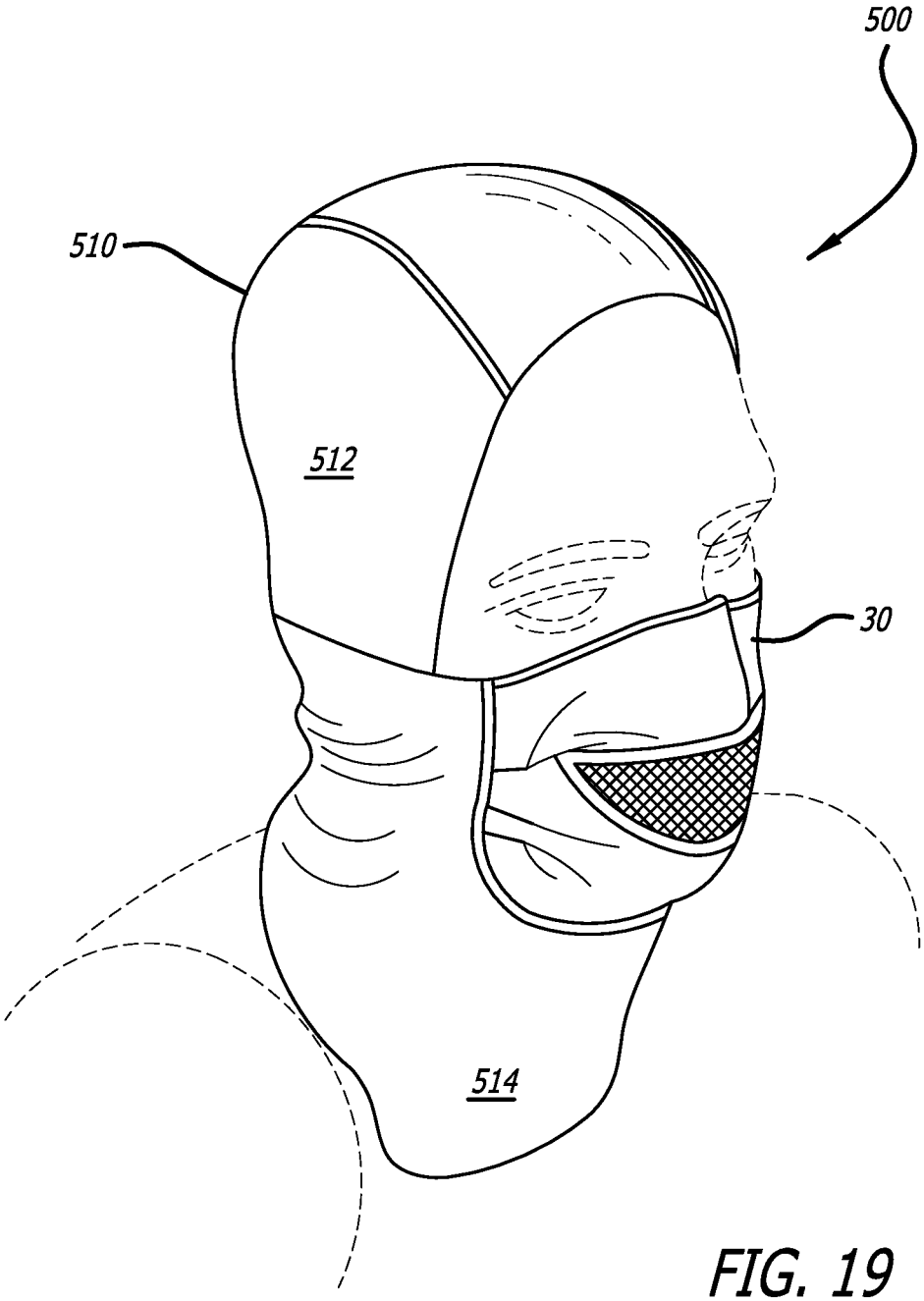
FIG. 19 is a perspective view of another face mask embodying the invention, as worn by a user.
Figure 20:
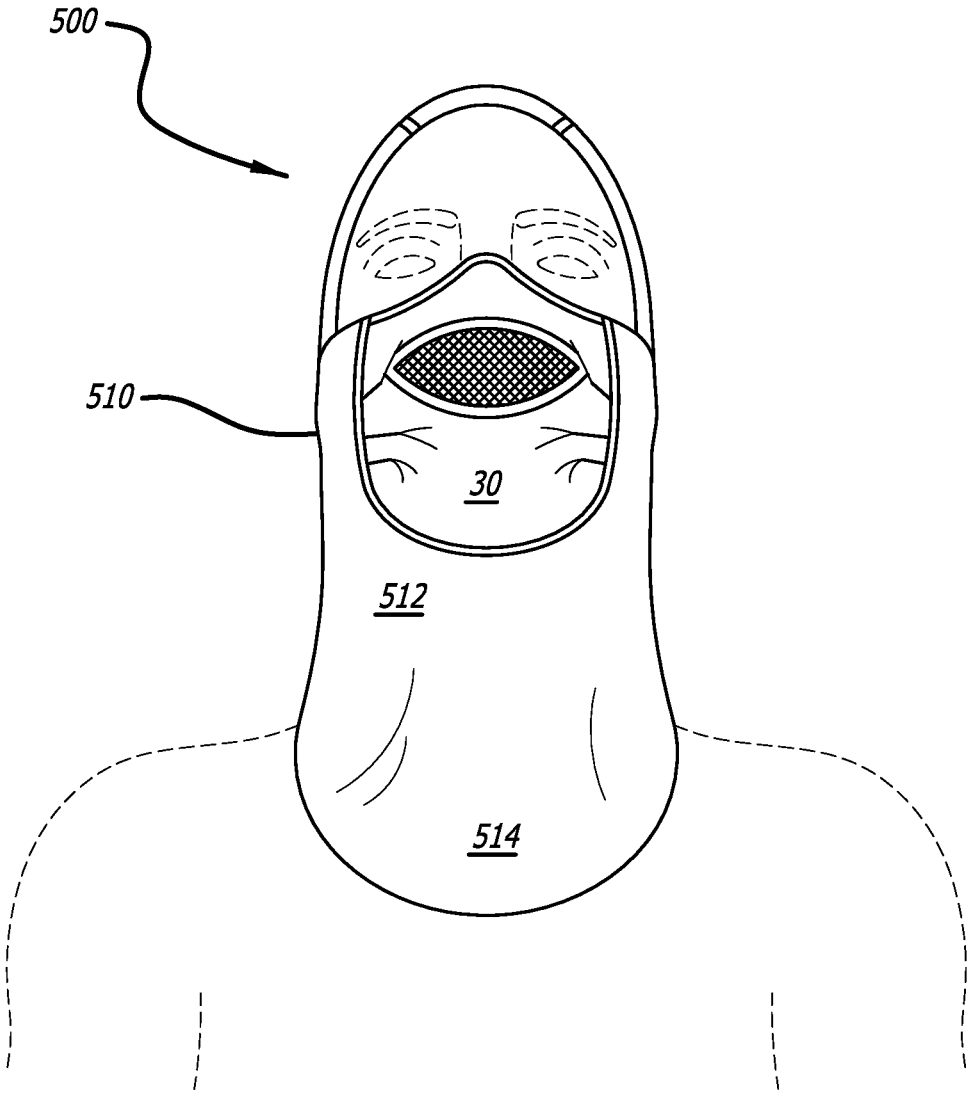
FIG. 20 is a front view of the face mask of FIG. 19.
Figure 21:
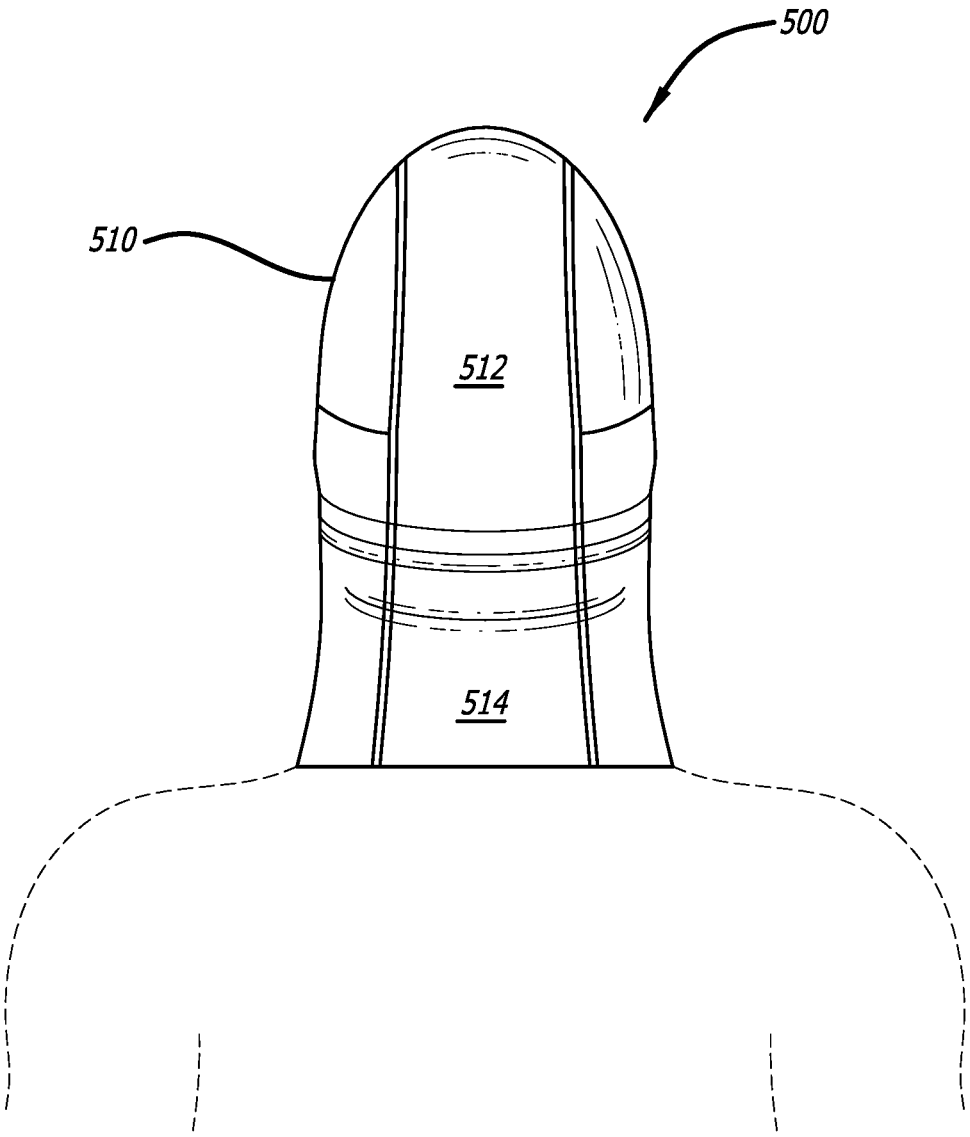
FIG. 21 is a rear view of the face mask of FIG. 19.

As seen in FIGS. 13-15, a face mask embodying the invention is in the form of a full mask with neck warmer 300 where the mask module 30 engages the head module 310. The full mask with neck warmer 300 is similar in construction to the full mask 200, described above, and incorporates most, if not all, of the same attributes. However, the head module 310 comprises a unitary portion 312, connected to and extending away from the sides of the mask module 30, that also includes a neck warmer portion 314 made from the same material as the rest of the unitary portion 312. The unitary portion 312 and neck warmer portion 314 may be made of the same material as the mask module 30. Alternatively, the unitary portion 312 and neck warmer portion 314 are made of a material different from that of the material of the mask module 30 (e.g., a 100% polyester fleece fabric) or a mixture of materials (e.g., parts of the unitary portion 312 and neck warmer portion 314 are made of the same material as the mask module 30 while other parts of the unitary portion 312 and neck warmer portion 314 are made of a material different from that of the mask module 30). Likewise, the unitary portion 312 and neck warmer portion 314 may each be made of the same material or from different materials. The material of the unitary portion 312 is resiliently expandable, stretchable to fit around the user's head and neck, and secure the full mask 300 in position.

As seen in FIGS. 16-18 and FIGS. 19-21, face masks embodying the invention are in the form of two types of balaclava mask 400, 500 where the mask modules 30 engages the head modules 410, 510. Both balaclava masks 400, 500 are similar in construction to the full mask with neck warmer 300, described above, and incorporates most, if not all, of the same attributes. Each of the head modules 410, 510 comprise a unitary portion 412, 512 connected to and extending away from the sides of the mask module 30, and also include a neck warmer portion 414, 514 made from the same material as the rest of the unitary portion 412, 512. The unitary portion 412, 512 and neck warmer portion 414, 514 may be made of the same material as the mask module 30. Alternatively, the unitary portion 412, 512 and neck warmer portion 414, 514 are made of a material different from that of the material of the mask module 30 (e.g., a 100% polyester fleece fabric) or a mixture of materials (e.g., parts of the unitary portion 412, 512 and neck warmer portion 414, 514 are made of the same material as the mask module 30 while other parts of the unitary portion 412, 512 and neck warmer portion 414, 514 are made of a material different from that of the mask module 30). Likewise, the unitary portion 412, 512 and neck warmer portion 414, 514 may each be made of the same material or from different materials. However, the balaclava mask 400, completely cover the user's head except for the user's eyes and lower forehead while the balaclava mask 500 completely cover the user's head except for the user's eyes and most of the user's forehead. The material of the unitary portion 412, 512 is resiliently expandable, stretchable to fit around the user's head and neck, and secure the balaclava masks 400, 500 in position.

Figure 22:
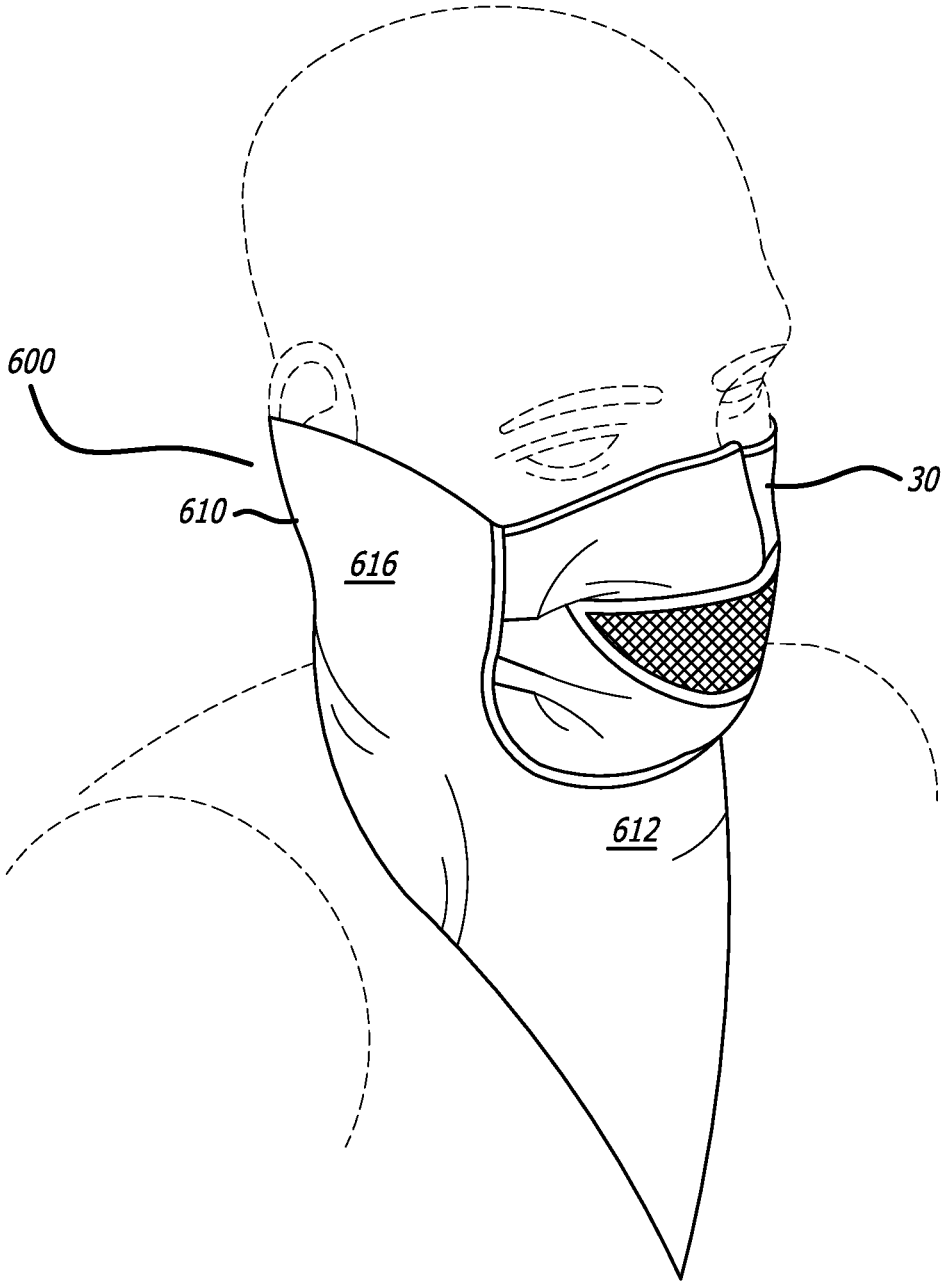
FIG. 22 is a perspective view of another face mask embodying the invention, as worn by a user.
Figure 23:
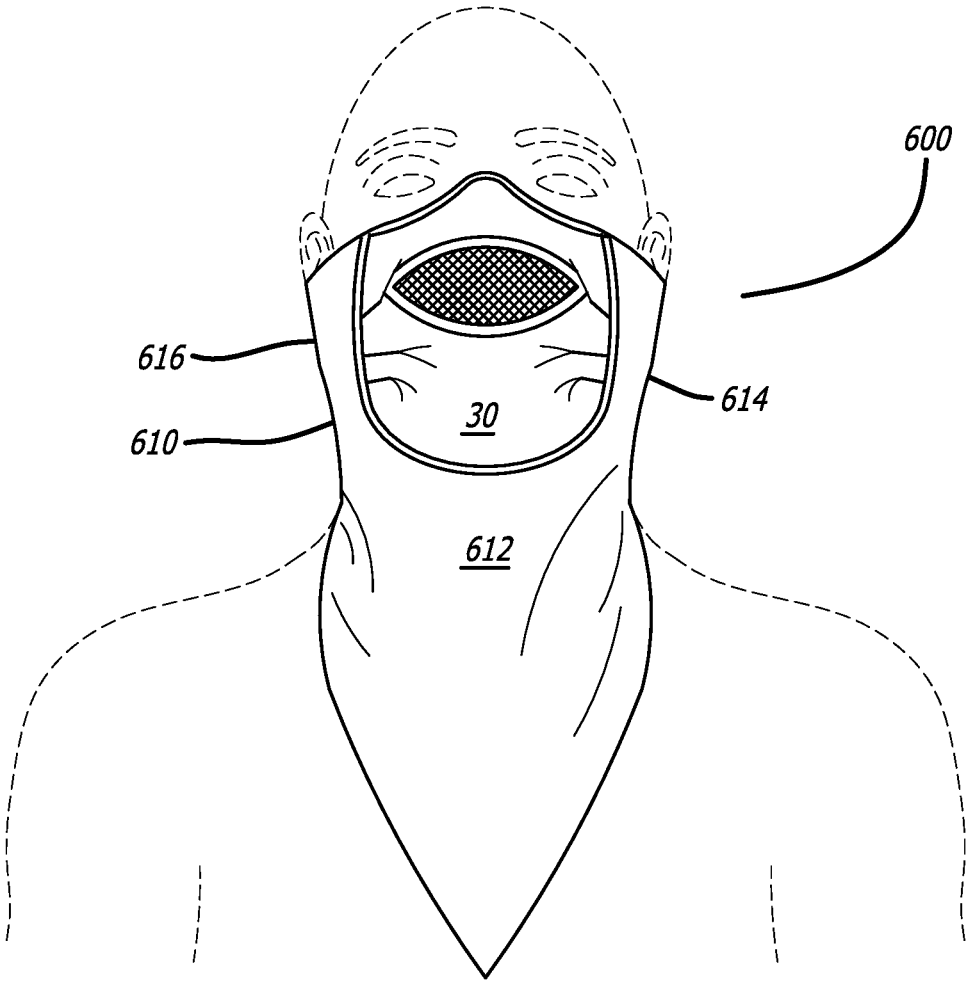
FIG. 23 is a front view of the face mask of FIG. 22.
Figure 24:
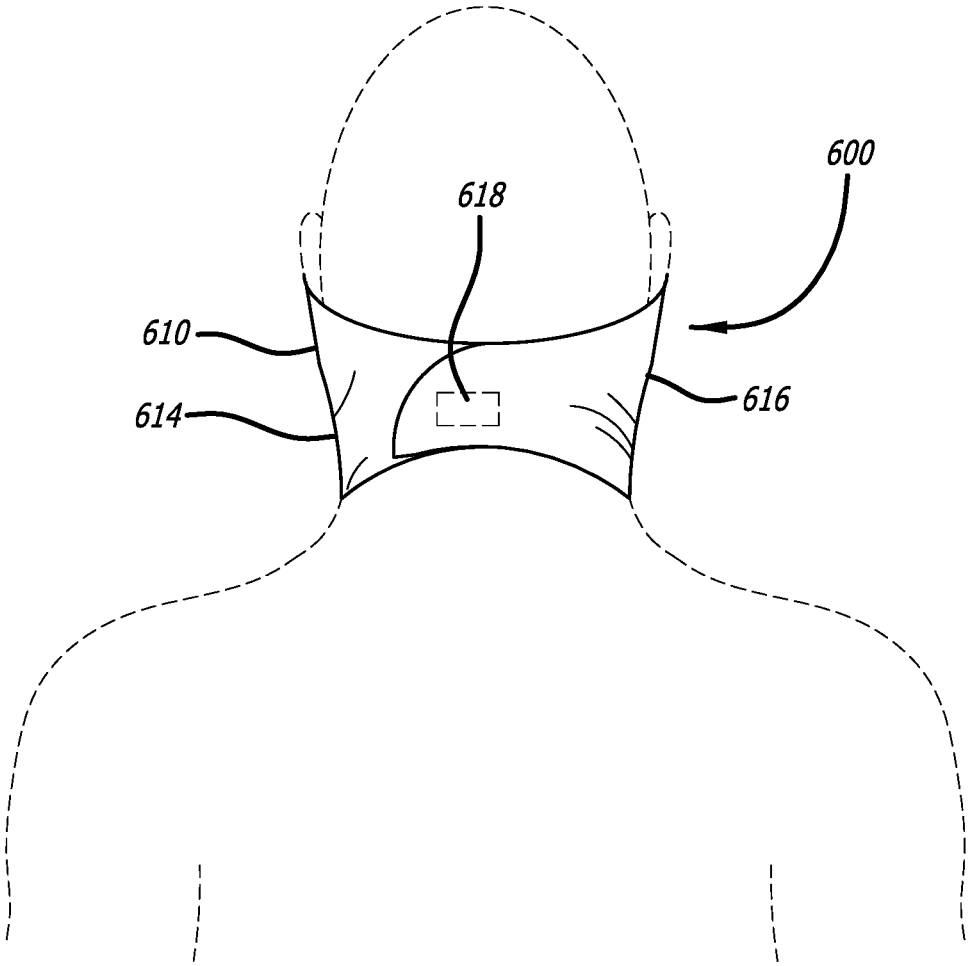
FIG. 24 is a rear view of the face mask of FIG. 22.

As seen in FIGS. 22-24, a face mask embodying the invention is in the form of a bandana mask 600 where the mask module 30 engages the head module 610. The head module 610 comprises central, left, and right portions 612, 614, 616 connected to and extending away from the mask module 30, around the back of the user's head and downwards around the sides and front of the user's neck. The central, left, and right portions 612, 614, 616 are made of the same material as the mask module 30. Alternatively, the central, left, and right portions 612, 614, 616 are made of a material different from that of the material of the mask module 30 (e.g., a 100% polyester fleece fabric) or a mixture of materials (e.g., parts of the central, left, and right portions 612, 614, 616 are made of the same material as the mask module 30 while other parts of the central, left, and right portions 612, 614, 616 are made of a material different from that of the mask module 30). Likewise, the central, left, and right portions 612, 614, 616 may each be made of the same material or from different materials. The mask 30 and head 610 modules may permanently connected (e.g., sewn together using flatseam construction to minimize bulky seams between the mask 30 and head 110 modules, chemically connected, etc.) or, in the alternative, removably connected using various fasteners including, without limitation, mechanical fasteners (e.g., hook and loop fasteners (e.g., VELCRO fasteners), zippers, pins, clips, latches, straps, hook and eye fasteners, toggle fasteners, snaps (male and female), buttons and button holes, straps and buckles, any type of male/female engaging fasteners, or the like).

The left and right portions 614, 616 are wrapped around the user's head. Fasteners 618 disposed on the distal ends of the left and right portions 614, 616 matingly engage and hold the bandana mask 600 snugly on the user's head. The left and right portions 614, 616 cover at least a portion of the user's ears (i.e., depending on the size of the individual user's ears), and hold the mask module 30 snugly to the user's face with the underside of the user's chin and jaw snugly contained by the mask module 30. The fasteners 618 may come in a variety of forms including, without limitation, mechanical fasteners (e.g., hook and loop fasteners (e.g., VELCRO fasteners), zippers, pins, clips, latches, straps, hook and eye fasteners, toggle fasteners, snaps (male and female), buttons and button holes, straps and buckles, any type of male/female engaging fasteners, or the like), magnetic fasteners or the like. In the alternative, the left and right portions 614, 616 are permanently connected (e.g., sewn together using flatseam construction, a single unitary piece of material, or the like) and the material of the left and right portions 614, 616 is resiliently expandable, stretchable to fit around the user's head and secure the bandana mask 600 in position.

The masks 100, 200, 300, 400, 500, 600 described above can be used in combination with goggles worn by a user to cover the user's eyes. Goggles are typically held over the user's face by an elastic, flexible, length-adjustable strap attached to the goggles. The strap fits around the user's head and positions the goggles over the user's eyes. Goggles can become fogged up when a user's warm, moist, exhaled breath (containing water vapor) rises upwards from the user's mouth, comes into contact with the external environment, which in turn causes goggles worn by the user to fog up when the rising water vapor comes into contact with the goggles. Thus, when a user wears goggles while also wearing a mask 100, 200, 300, 400, 500, 600, the construction of the masks 100, 200, 300, 400, 500, 600 seals off the user's exhaled breath from the external environment and thereby prevents the user's exhaled breath from fogging up the lenses on the user's goggle. The upper portion 36 of the mask module 30 conforms to contours of the user's face, forming a seal between the interior space 46 of the mask module 30 and the external environment. The seal between the upper portion 36 and the external environment prevents goggles worn over the user's face from fogging up as exhaled, warm moist breath is prevented, or at least mostly prevented, from exiting the mask module 30 along the upper portion 36. For example, the flexible band 54 disposed in the upper portion 36 of the mask module 30 allows the upper portion 36 to fit to the face and to the inside of the goggle's frame, thereby preventing the goggles from fogging up.

In an alternative, any one or more of the face masks 100, 200, 300, 400, 500, 600 can also be integrated into a pullover garment, a dickie, scarf, neck warmer or multiple types of hats as a drop down liner. Additionally, any one or more of the face masks 100, 200, 300, 400, 500, 600 can also be integrated into other wearable garments.

Although the present invention has been discussed above in connection with use in outdoor cold weather environments, the present invention is not limited to that environment and may also be used in natural and man-made cold environments such as natural caves, cold-storage facilities, refrigerated containers, walk-in freezers, or the like.

In the alternative, the present invention may also be adapted for non-cold related uses. For example, in alternative embodiments, the mask module 30 can be adapted for use in environments where the air is laden with dust and/or pollen. For example, the face masks 100, 200, 300, 400, 500, 600 can be adapted for use in dust/sand storms, windy days with significant and high levels of pollen, and the like. In the foregoing situations, the mouthpiece 42 could be adjusted to provide one or more of the layers with increased air filtration properties or by adding an additional filter layer to the mouthpiece 42. Likewise, the mask module 30 could be adapted to use a lighter weight material for use in a warmer climate/environment. In a further alternative, the mask module 30 can be adapted for use in polluted environments where, for example, the mouthpiece 42 is adjusted to provide one or more of the layers with increased filtration properties or by adding an additional filter layer to the mouthpiece 42.

In a further alternative, the materials used in the face masks 100, 200, 300, 400, 500, 600 could be treated with various substances (e.g., aromatic, medicinal, therapeutic, or the like) or constructed with additives that provide aromatic, medicinal and/or therapeutic effects on the person wearing the face mask 100, 200, 300, 400, 500, 600.

In addition, the claimed invention is not limited in size and may be constructed in versions suitable for adults and non-adults in which the same or similar principles of cold weather protection as described above would apply. Likewise, the size and shapes of the face masks and their components described above are not to be construed as drawn to scale in the figures referred to herein, and that the sizes of the face masks may be adjusted in conformance with industry standard sizes for adult and non-adult humans. Furthermore, the figures (and various components shown therein) of the specification are not to be construed as drawn to scale.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "front," "rear," "left," "right," "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention.

What is claimed is:

1. A mask for protecting a head with a face having a nose, mouth, and chin, comprising:

a mask module formed of a material, wherein the mask module comprises an exterior surface and an interior surface, the mask module being sized and shaped to cover a portion of the face;

wherein the mask module further comprises an adjustable upper portion, a middle portion, and a lower portion, wherein the upper portion conforms to at least a portion of the nose, and the middle portion includes a multi-layer mouthpiece connected to the mask module, a first plurality of pleats, and a second plurality of pleats, wherein the first and second plurality of pleats are generally disposed on opposite sides of a first side of the mask module from each other, wherein the pleats provide an accordion-effect in the material of the mask module that defines a space between the interior surface of the mask module and at least the mouth when the mask is worn over the face; and a head module engaging the mask module, wherein the head module is configured to engage at least a portion of the head.

2. The mask of claim 1, wherein the upper portion includes a flexible band disposed therein, wherein the band is conformable to at least a portion of the nose.

3. The mask of claim 2, wherein the band extends within the upper portion across the face, and generally conforms to contours of the face over which the band is disposed, thereby generally dispersing weight of the mask on the face generally along the band.

4. The mask of claim 3, wherein ends of the band extend in generally opposite directions, away from the nose.

5. The mask of claim 2, wherein the band can be reconfigured to regulate temperature within the mask module and air volume moving in or out of the mask.

6. The mask of claim 1, wherein shape of the upper portion is adjustable to increase/decrease contact between the mask and the face, thereby adjusting pressure of the mask on the face.

7. The mask of claim 1, wherein shape of the upper portion is adjustable to regulate air volume in and/or out of the mask.

8. The mask of claim 1, wherein shape of the upper portion against the face defines at least one passage for air to move in or out of the mask, wherein the at least one passage regulates at least one of temperature within the space, pressure points of the mask on the face, and air volume in and/or out of the mask.

9. The mask of claim 1, wherein air within the space is generally warmer than air external to the mask module, and the space allows for movement of the mouth and chin while maintaining the mask module substantially in place.

10. The mask of claim 1, wherein the multi-layer mouthpiece comprises an outer material layer, a middle spacer layer, and an inner material layer; wherein the mouthpiece prevents direct ingress of incoming air, with the outer material layer deflecting and diffusing incoming air, and the middle spacer layer providing an air trap warming incoming air.

11. The mask of claim 1, wherein the mask and head modules are sewn together using flatseam construction to minimize seams, wherein at least a portion of each module is made of the same material.

12. The mask of claim 1, wherein the mask module is integrally connected with the head module, and is made of the same material as at least a portion of the head module.

13. The mask of claim 1, wherein engagement of the mask and head modules comprises at least one of a module mask, a full mask, a full mask with neck warmer, a balaclava mask, and a bandana mask.

14. The mask of claim 1, wherein the material comprises an insulating/breathable fabric.

15. The mask of claim 1, wherein the material includes wicking and anti-microbial properties.

16. The mask of claim 1, wherein the material comprises a three layer fabric that includes a waterproof/breathable middle membrane, and wherein the exterior surface is treated with a water repellent finish.

17. The mask of claim 1, wherein the mask is sized and shaped to snugly cover a portion of the head.

18. The mask of claim 1, wherein the upper portion of the mask module conforms to contours of the face, forming a seal between an interior of the mask module and external environment, and thereby preventing goggles worn over the face from fogging.

* * * * *